US007695414B2

(12) United States Patent
Tiahrt

(10) Patent No.: US 7,695,414 B2
(45) **Date of Patent: *Apr. 13, 2010**

(54) VARYING FORCE VECTOR EXERCISE DEVICE FOR INDUCING MUSCULATURE PERTURBATIONS

(76) Inventor: Leif K. Tiahrt, 1417 Mountain Ave., Santa Barbara, CA (US) 93101-4723

( * ) Notice: Subject to any disclaimer, the term of this patent is extended or adjusted under 35 U.S.C. 154(b) by 101 days.

This patent is subject to a terminal disclaimer.

(21) Appl. No.: 11/600,434

(22) Filed: Nov. 15, 2006

(65) Prior Publication Data

US 2007/0207902 A1 Sep. 6, 2007

Related U.S. Application Data

(63) Continuation-in-part of application No. 10/620,028, filed on Jul. 14, 2003, now Pat. No. 7,201,712.

(60) Provisional application No. 60/737,112, filed on Nov. 15, 2005.

(51) Int. Cl.
*A63B 21/00* (2006.01)

(52) U.S. Cl. ..... 482/133

(58) Field of Classification Search ..... 482/93–94, 482/97–103, 121, 135–136, 138–139, 70–72
See application file for complete search history.

(56) References Cited

U.S. PATENT DOCUMENTS

| | | | | | |
|---|---|---|---|---|---|
| 684,688 | A | | 10/1901 | Herz | |
| 4,149,714 | A | * | 4/1979 | Lambert, Jr. | 482/100 |
| 4,256,302 | A | * | 3/1981 | Keiser et al. | 482/100 |
| 4,643,420 | A | * | 2/1987 | Riley et al. | 482/130 |
| 4,911,431 | A | | 3/1990 | Parviainen | |
| 4,940,227 | A | | 7/1990 | Coffey | |
| 5,064,191 | A | * | 11/1991 | Johnson | 482/143 |
| 5,490,826 | A | * | 2/1996 | Rose | 482/74 |

(Continued)

OTHER PUBLICATIONS

Evolution of Strength Training Equipment, Julie M. King, M.S., Copyright 2006. Fitness Management, fitnessmanagement.com (website), 4 pages.

(Continued)

*Primary Examiner*—Fenn C Mathew
(74) *Attorney, Agent, or Firm*—Guy Cumberbatch

(57) ABSTRACT

A method for exercising one or more muscles of the body wherein one or more muscle(s) are contracted to move a limb through a range of motion in opposition to an oscillating resistive force. During a muscular contraction, the direction and/or the magnitude of the resistive force changes in an oscillatory fashion thereby inducing perturbations in the musculature. The oscillations in the magnitude and/or the direction of the resistive force include a plurality of cycles during a single repetition of muscular contraction. The waveform and frequency of the oscillations may vary during a repetition or remain constant. Embodiments of devices providing an oscillatory resistive force are presented. The embodiments provide means for enabling an exerciser to perform resistance-type exercises in accordance with the method. A guided spherical bearing may be used for rotating a lead pulley or a rigid arm to create lateral resistive force oscillations. Non-circular lead pulleys may be used to fluctuate the resistive force magnitude. The oscillations in magnitude and/or direction of the resistive force may be periodic or randomized such that during subsequent repetitions the oscillations occur at differing points.

22 Claims, 13 Drawing Sheets

U.S. PATENT DOCUMENTS

| | | | | |
|---|---|---|---|---|
| 5,755,645 | A | 5/1998 | Miller | |
| 6,004,244 | A * | 12/1999 | Simonson | 482/52 |
| 6,224,514 | B1 | 5/2001 | Price | |
| 6,338,701 | B1 | 1/2002 | Webber | |
| 6,488,612 | B2 | 12/2002 | Sechrest et al. | |
| 6,537,184 | B2 | 3/2003 | Kim | |
| 7,086,991 | B2 | 8/2006 | Williams et al. | |
| 7,201,712 | B2 * | 4/2007 | Tiahrt | 482/133 |
| 2002/0068666 | A1 * | 6/2002 | Bruccoleri | 482/93 |
| 2003/0232702 | A1 * | 12/2003 | Panatta | 482/94 |
| 2004/0005964 | A1 * | 1/2004 | Panatta | 482/99 |
| 2004/0014568 | A1 * | 1/2004 | Williams et al. | 482/37 |

OTHER PUBLICATIONS

Power Plate to Shake the Foundations of North American Heath & Fitness Industry with Cutting-Edge "Body Vibration", Power Plate Press Release, Sep. 16, 2002, 3 pages.

Shake, Rattle & Grow, Muscle & Fitness magazine, Apr. 2003, pp. 94-99, 4 pages.

* cited by examiner

LATERAL VIEW
300
FRONT VIEW
RESISTANCE
LEFT
RIGHT
RANGE OF MOTION

LATERAL VIEW
302
FRONT VIEW
RESISTANCE
LEFT
RIGHT
RANGE OF MOTION

LATERAL VIEW
304
306
FRONT VIEW
RESISTANCE
LEFT
RIGHT
RANGE OF MOTION

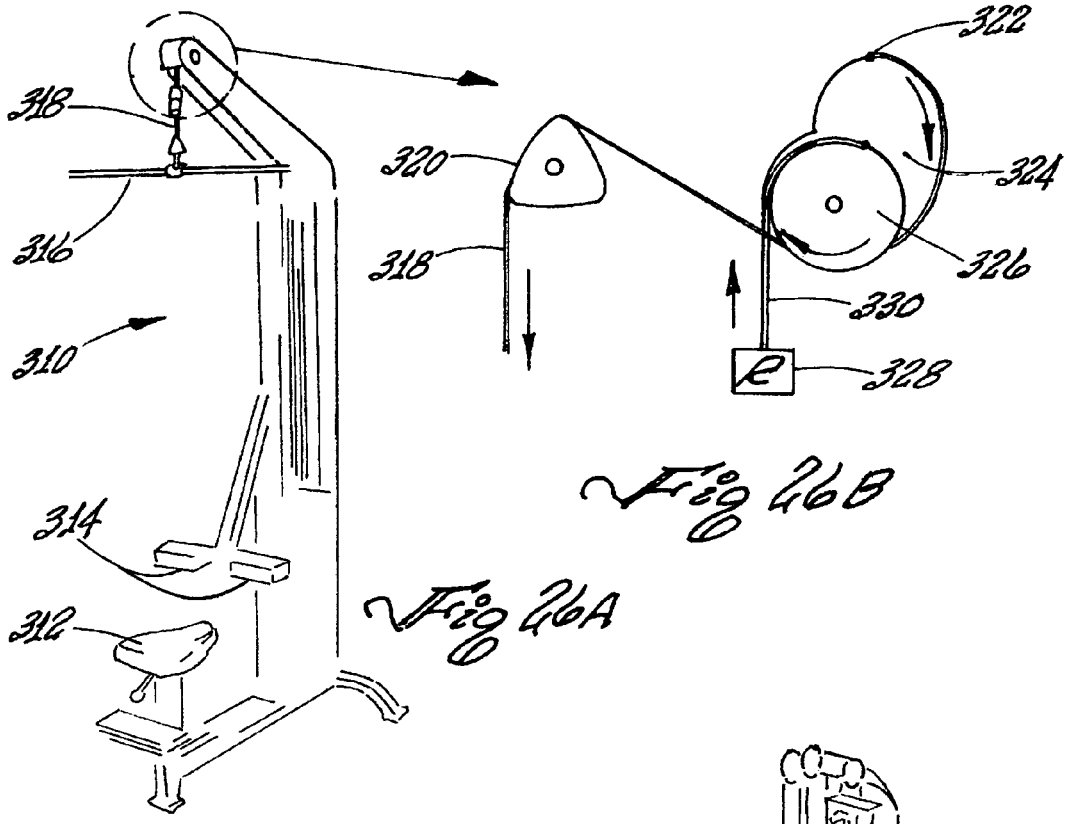
Fig 26B
Fig 26A
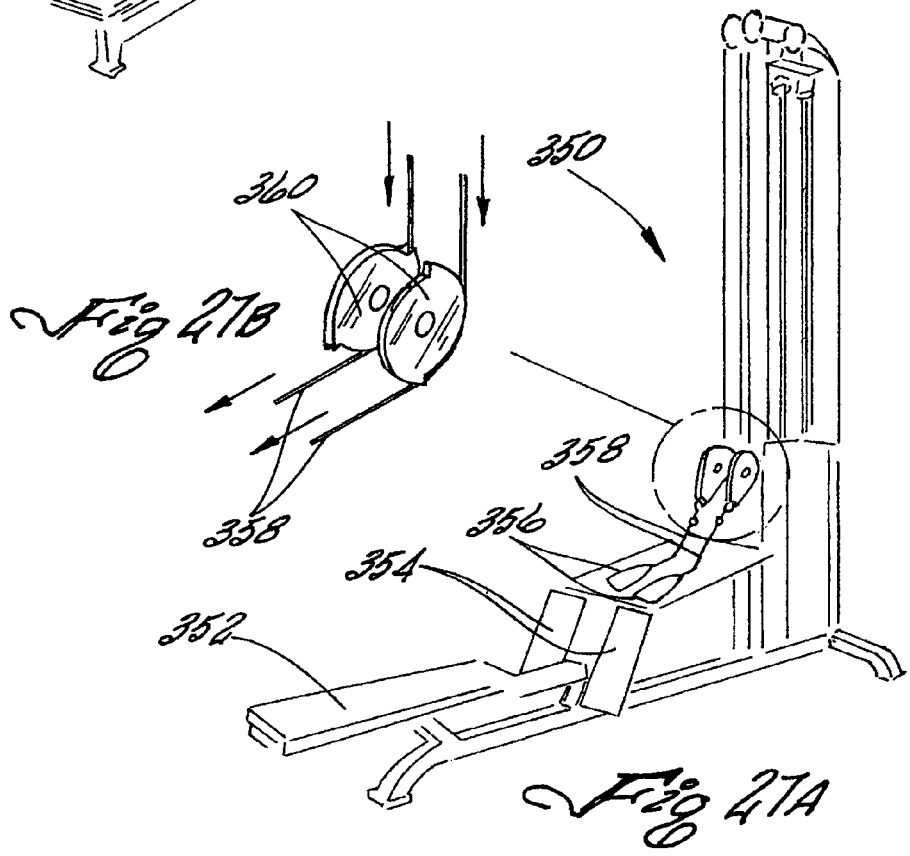
Fig 27B
Fig 27A

VARYING FORCE VECTOR EXERCISE DEVICE FOR INDUCING MUSCULATURE PERTURBATIONS

RELATED APPLICATIONS

The present application is a continuation-in-part of U.S. patent application Ser. No. 10/620,028, filed Jul. 14, 2003, now U.S. Pat. No. 7,201,712, and also claims priority under 35 U.S.C. §119(e) to Provisional Application No. 60,737, 112, filed Nov. 15, 2005, the contents of both of which are hereby incorporated by reference.

FIELD OF THE INVENTION

The present invention relates to a method for performing resistance-type exercises and, more particularly, to a method and devices operable for changing the direction and magnitude of a resistive force in a cyclic manner multiple times (oscillations) in a periodic or random manner during a single repetition of muscular contracture. The invention also relates to the means for changing the direction and magnitude of the resistive force experienced by movement of a contact member, and in particular bearings and/or multilobal pulleys used to implement the oscillations.

BACKGROUND OF THE INVENTION

Resistance exercise devices are well known in the art. Resistance exercises normally involve the contraction of a muscle against an opposing resistive force to move a portion of the body through a range of motion. The contraction is usually repeated to include a plurality of cycles (repetitions) of motion of the body portion through the range of motion, which range is determined by the degree of muscular contraction and extension achieved during a repetition. The resistive force may be provided by gravity, as with weight training (barbells, dumbbells, pull-up and pull-down stacks of weights, etc.), by an elastic force such as springs, bungees, pneumatic or hydraulic mechanisms, flexible rods and the like, or by flywheel or pulley braking devices.

Weight lifting is an exercise in which muscles contract against a resistance through a range of motion. The resistance is normally in the form of a weighted object that the user moves through either a flexion or extension of a body portion such as the arms or legs. In weight lifting, there are a number of exercises in which the user moves a weighted barbell in order to strengthen his or her upper, lower and torso body muscles. One example of such an exercise is a bench press in which the individual initially assumes a supine position atop a support bench. The weightlifter then uses his or her arms to lift the barbell from a position just above the lifter's chest to a higher vertical position where the lifter's arms are fully extended. This exercise is normally accomplished without any sideways movement, such as abduction or adduction of the lifter's hands. This basic exercise can be modified by inclining the support bench (inclined press) or by starting with the bar substantially coplanar with the user's torso (pull-overs).

In the biomechanics of limb function, one or more joints contribute to the limb's functional motion. Each time the limb moves, motion takes place in one or more of these joints. Limb movement, such as movement of the arm, may include flexion, extension, abduction, adduction, circumduction, internal rotation, and external rotation. These movements are usually defined in relation to the body as a whole. Flexion of the bicep is an upward movement of the forearm towards the shoulder when bending at the elbow. Abduction is the movement of raising the arm laterally away from the body; adduction, the opposite of this, is then bringing the arm toward the side. Circumduction is a combination of all four of the above defined movements, so that the hand describes a circle. Internal rotation is a rotation of the arm about its long axis, so that the usual anterior (front) surface is turned inward toward the body; external rotation is the opposite of this, with the posterior (rear) surface turned inward.

All movements of limbs, for example, the arm relative to the shoulder, can be described by the terms used above. It will be appreciated by the artisan that most movements of a limb such as the arm are combinations of two or more of the above defined movements. A plurality of muscles cross each limb joint. Their function is to create motion, and thus the ability to do work with the limb. To perform a given task with precision, power, endurance, and coordination, most, if not all, of these muscles must be well conditioned.

The function of each of these limb muscles depends on its relative position to the joint axis it crosses, the motion being attempted, and any external forces acting to resist or enhance motion of the limb. During limb motion, groups of muscles interact so that a desired movement can be accomplished. The interaction of muscles may take many different forms so that a muscle serves in a number of different capacities, depending on movement. At different times a muscle may function as a prime mover, antagonist, or a fixator, or synergistically as a helper, a neutralizer or a stabilizer.

For example, consider flexion of the arm. There are three major joints which contribute to elbow function: the ulnar-humeral, radio-humeral, and the radio-ulnar, all referencing interaction between the three main arm bones. The ulnar-humeral is responsible for flexion and extension while the radio-humeral and the radio-ulnar joints are responsible for supination and pronation. Flexion is movement in the anterior direction from the position of straight elbow, zero degrees to a fully bent position such as a curl. Extension is movement in a posterior direction from the fully bent position to the position of a straight elbow.

A plurality of muscles effect motion at each limb joint. For example, in the elbow, these include the Biceps brachii, the Brachialis and the Triceps brachii. These muscles are continually active as their role changes in performing the complex activities of daily living. Each muscle spanning a limb joint has a unique function depending on the motion being attempted. It is generally conceded that in order to fully train and strengthen limb musculature, it is necessary to work the limb in all planes and extremes of motion to optimize neuromuscular balance and coordination.

There are three types of muscular contractions—concentric, static and eccentric. A concentric (or positive) contraction is one in which a muscle shortens against a resistance such as when you raise a weight. A static (or isometric) contraction occurs when a muscle exerts tension but there is no significant change in its length. This happens when you push or pull against an immovable object. Lastly, an eccentric (or negative) contraction is one in which a muscle lengthens against a resistance such as when you lower a weight.

The types of limb exercise and/or exercise devices currently used in exercise programs generally include isometric, isotonic and isokinetic exercise. Isometrics is an exercise that is performed without any joint motion taking place. For example, pressing a hand against an immovable object such as a wall. When exercising a muscle group within a limb, strength can be improved only in the range of motion in which the limb is being exercised. Since in isometric exercises only one position and one angle can be used at one time, isometric exercise is time consuming if done correctly.

Isotonic exercises are done against a movable resisting force. The resisting force is usually free weights. Isotonic exercises are probably the most common method for exercising when using both the upper and lower limbs as free weights are relatively inexpensive to acquire and readily available in gyms. A weight is held in the hand and moved in opposition to gravity. It is a functional advantage to be able to move a limb through a full range of motion, but because of the unidirectional nature of gravity, the body position must be continually changed for all muscles to be exercised.

During a single repetition of isotonic weightlifting, the load remains constant but the amount of stress on the muscle varies. The most difficult point in the range is the initial few degrees with a movement to overcome inertia. As the upper extremity comes closer to the vertical position, work becomes easier due to improved leverage. This creates a non-cyclic variability in the degree of muscle tension throughout the range of motion. Isotonic exercises can be performed on Nautilus and similar machines which achieve a more uniform resistance. Nautilus-type machines feature a cam-shaped pulley (shaped like the circumference of a Nautilus swirling sea shell) that provides a transmission to increase or decrease the tensile load in a cable fixed to the pulley so that the exerciser experiences a more uniform resistance. The varying tensile load adjusts to the body's natural strength curve throughout the entire range of motion, making the movement feel easier in positions where the body is weaker and more difficult where the body is stronger. For example, performing an arm curl with a free weight is more difficult at the beginning than toward the end of the motion because of increased leverage at the elbow as the curl progresses. In contrast, the cam pulley or track line of a Nautilus machine varies the resistance levels so that the effort required to begin an arm curl is approximately equal to the effort required at the end. A major disadvantage is that motion on these weightlifting machines is confined to a straight plane movement without deviation which does not replicate normal in-use movement of the limb.

Isokinetic exercise involves a constant speed and a variable resistance. The resistance imparted by these devices increases in response to increases in the force produced by the muscles, thereby limiting the velocity of movement to roughly isokinetic conditions over part of their range. The operating principle is that strength is best developed if muscle tension is kept at a maximum at every point throughout the range, though this principle has not been universally accepted. Isokinetic exercise machines are limited to movement of a limb in one straight plane, though the resistive force can be bidirectional within that plane of movement, for example, on the flexion and extension strokes of an arm curl. Each of the systems available has its own features but basically they are all the same in that they have a rotating lever arm which moves in a single plane. Moreover, the machines are typically quite expensive as they utilize servo motors and microprocessors in so-called active dynamometry. Typically, electronic servomotors or a hydraulic valve controls the lever arm in both directions. Exemplary systems are sold by Cybex, Biodex, Isocom, and Kin-Com AP.

The particular muscle fibers involved in a contraction during a single repetition of resistive exercise depends upon the direction of the resistive force vector. If the resistive force vector is constant during a repetition, both directionally and in magnitude, as is the case with most prior art resistance exercise devices, only the muscles and portions of the muscle fibers within a muscle that are necessary to counter the resistive force will contract. Pull-down/press-down ("PD2") types of exercise devices, such as, for example, disclosed in U.S. patent application Publication No. US2002/0068666 by Bruccoleri, have been further improved to include flexible members (e.g., ropes) attached to a horizontal resistance bar. The flexible members are adapted to be grasped by the hands. In operation, the user naturally changes the direction of the resistive force vector during a repetition such that different muscles and different muscle fibers within a muscle are exercised during the repetition. The prior art pull-down/press-down resistance type of exercise devices, such as the device shown in FIG. 1, enable the user to exercise a plurality of muscles during a repetition because the user varies the plane of motion of the limbs during a repetition.

Despite many configurations of exercise machines developed over the years, there remains a need for a more holistic and effective training machine that activates a broader range of muscle groups in a single repetition.

SUMMARY OF THE INVENTION

In accordance with one aspect of the present invention, an exercise machine for exercising one or more muscles of the body of an exerciser comprises a contact member movable in one direction through a distance defining a range of motion. A mechanical connection transmits a resistive force from the source of force along a resistive force vector in opposition to movement of the contact member through its range of motion. For instance, the mechanical connection may be a cable. A support for the mechanical connection changes the direction of the resistive force vector a plurality of times during movement of the contact member through its range of motion such that the exerciser experiences an oscillating force vector.

Accordance with a preferred embodiment, the support for the mechanical connection also changes the magnitude of the resistive force a plurality of times during movement of the contact member through its range of motion such that the exerciser also experiences an oscillating magnitude of the resistive force. The mechanical connection may comprise a cable, and the support comprises a lead pulley having a rotational axis and a groove over which the cable traverses. The lead pulley groove may be non-circular which creates the oscillating magnitude of the resistive force. Alternatively, the support for the mechanical connection is controlled by a programmable controller which randomly changes the direction of the resistive force vector. Ideally, the oscillating force vector changes direction during movement of the contact member through its range of motion at least twice. In accordance with one embodiment, the mechanical connection comprises a cable, and the support comprises a lead pulley having a rotational axis and a groove in which the cable is supported. As the pulley rotates, a cable guide portion of the groove oscillates laterally along the pulley axis of rotation.

Accordance with a second aspect of the present invention, an exercise machine for exercising one or more muscles of the body of an exerciser provides an oscillating magnitude of the resistive force. The device has a contact member, a source of force, and a mechanical connection between the contact member and the source of force. The contact member moves in at least one direction through a distance defining a range of motion. The mechanical connection transmits a resistive force from the source of force along a resistive force vector in opposition to movement of the contact member through its range of motion. Finally, an oscillator engages the mechanical connection and changes the magnitude of the resistive force a plurality of times during movement of the contact member through its range of motion.

In one version, the oscillator is controlled by a device such as a hydraulic pump, a pneumatic pump, or a programmable controller. Furthermore, the oscillator may include a programmable controller which randomly changes the magnitude of the resistive force. Desirably, the oscillating magnitude of the resistive force changes during movement of the contact member through its range of motion at least twice. In a preferred embodiment, the mechanical connection comprises a cable, and the oscillator comprises a lead pulley. The lead pulley has a groove over which the cable traverses, and the groove may undergo lateral oscillating movement relative to an axis of rotation of the pulley. For instance, the lead pulley mounts on a guided spherical bearing which creates the oscillating movement of the groove.

Accordance with a third aspect of the present invention, a pulley-based exercise machine for exercising one or more muscles of the body comprises a contact member movable in one direction through a distance defining a range of motion. A cable attaches to the contact member and is supported within a groove of a lead pulley having a rotational axis. A source of tensile force is provided on the cable on the opposite side of the lead pulley from the contact member so as to oppose movement of the contact member through its range of motion and manifest in a resistive force in the cable directed along a resistive force vector from the contact member to the lead pulley. Finally, the lead pulley changes the direction of the resistive force vector a plurality of times during movement of the contact member through its range of motion such that the exerciser experiences an oscillating force vector.

In one embodiment, the exercise machine includes means for changing the magnitude of the resistive force a plurality of times during movement of the contact member through its range of motion such that the exerciser also experiences an oscillating magnitude of the resistive force. For instance, the means for changing the magnitude of the resistive force is provided by the lead pulley which is non-circular. Alternatively, the means for changing the magnitude of the resistive force includes a programmable controller which randomly changes the magnitude of the resistive force. As the lead pulley rotates a cable guide portion of the groove may oscillate laterally along the pulley axis of rotation so that the direction of the resistive force vector oscillates a plurality of times during movement of the contact member through its range of motion. In one embodiment, the lead pulley is a disk-shaped pulley having a groove lying in a plane and may be mounted for rotation on a guided bearing that changes the orientation of the plane of the pulley groove as the pulley rotates, or may be mounted for rotational about an axis with the plane of the pulley groove in an orientation that is other than orthogonal from the axis.

It is an object of the present invention to provide a resistance exercise device operable for providing resistance to the movement of a muscle wherein the direction of the resistive force oscillates in a cyclic fashion during a single repetition. The oscillating resistive force increases the distance a contact member travels and increases the number of muscle fibers involved in the contraction over that when using a unidirectional device.

It is an object of the present invention to provide a resistance exercise device operable for providing resistance to the movement of a muscle wherein the magnitude of the resistance oscillates for a plurality of cycles during contraction of the muscle that occurs while performing a single repetition.

It is yet a further object of the present invention to provide a resistance exercise device operable for providing resistance to the movement of a muscle wherein both the direction and the magnitude of the resistance oscillates for a plurality of cycles during contraction of the muscle.

It is yet a further object of the present invention to provide for a randomizing of the changes in direction and/or magnitude of the resistive force acting upon the exerciser such that the directional vector and/or force vector are non-repeating in subsequent repetitions and the paths of directional vector and force magnitude vector are infinite.

The present invention also provides means for effectuating changes in the direction and magnitude of the resistive force experienced by movement of a contact member, and in particular bearings and/or multilobal pulleys used to implement the oscillations.

The present application discloses pulleys and bearings that provide either a randomly or predictably changing direction of travel for removing member guided thereby. In one embodiment, the pulleys are axially mounted on the bearing wherein the rotational axis of the bearing is tilted with respect to the axis of symmetry of the pulley. The outer diameter of the pulley may be uniform or may vary around the circumference of the pulley. For example, multilobal lead pulleys vary the magnitude of the resistance force. Alternatively, a multilobal lead pulley may have a cylindrical axial bore that is tilted with respect to a line orthogonal to the plane of the pulley so that the pulley wobbles as is rotates.

The present invention also provides a bearing on which any of the pulleys disclosed in the present application may be mounted, which bearing causes the pulley to wobble. The bearing may have an annular outer race with an outer surface and an inner surface, wherein the inner surface is concave, preferably spherical. A hemi cylindrical race groove or track is provided around the circumference of the inner surface. A partially spherical inner member has an outer surface with a second hemi cylindrical groove or track around a circumference thereof. The inner member is housed within the outer race and desirably has an axial bore enabling it to be fixedly mounted on a shaft. At least a portion of both the first and second hemi cylindrical grooves juxtapose to form, at least at one point, a cylindrical cavity between the outer race and the inner spherical member. A ball disposed within the cylindrical cavity constrains the relative positions of the outer race and inner member. The first or second groove may be linear (orthogonal to axial or tilted) or curvilinear, desirably causing the race to wobble as it rotates around the inner member.

In accordance with one aspect, the present invention provides a method for performing a repetitive resistance exercise comprised of a plurality of repetitions. The method includes providing an exercise device having a source of resistive force, a contact member that can be manipulated by a user, and a transmission extending between the source of resistive force and a contact member. The user manipulates the contact member through a range of motion, wherein during the range of motion the transmission exerts an oscillating resistive force to the contact member. The resistive force may oscillate in magnitude and/or direction.

In one embodiment, the present invention provides a system having a bilateral force transmission within which two contact members unilaterally oscillate. For example, the exemplary exercise device has more than one contact member (handgrip) and associated force transmission system (lead pulley) that function independently from each other.

A further understanding of the nature and advantages of the present invention are set forth in the following description and claims, particularly when considered in conjunction with the accompanying drawings in which like parts bear like reference numerals.

BRIEF DESCRIPTION OF THE DRAWINGS

Features and advantages of the present invention will become appreciated as the same become better understood with reference to the specification, claims, and appended drawings wherein:

FIGS. 21A-23A illustrate exemplary groove patterns in an inner member used in guided spherical bearings of the present invention;

FIGS. 21B-23B illustrate exemplary groove patterns in an outer race used in guided spherical bearings of the present invention;

FIG. 26A is a perspective view of a pull-down/press-down exercise device of the present invention;

FIG. 26B is a schematic elevational view of a force transmission system for use in the exercise device of FIG. 26A;

FIG. 27A is a perspective view of a seated rowing exercise device of the present invention; and FIG. 27B is a schematic perspective view of an exemplary force transmission system for use in the device of FIG. 27A.

DETAILED DESCRIPTION OF THE PREFERRED EMBODIMENTS

There are countless variations of weightlifting or conditioning machines for exercising all parts of the body. Each machine features at least one contact member that the user grasps, pushes, pulls, steps on or otherwise manipulates through a range of motion. For example, the contact member could be a pair of spaced apart but co-linear hand grips in a shoulder press device, or a straight bar or V-shaped close grip attached to a single cable in a lateral pull-down machine. Foot pedals and other contact members for the legs may also be incorporated into a modified device in accordance with the present invention.

In the context of the present invention, the term oscillating means to vary cyclically. One standard definition of oscillate is to swing or move to and fro, as a pendulum does (www.dictionary.reference.com). The exercise devices of the present invention provide an oscillating resistive force over a single range of motion. That means that the resistive force cycles or varies up and down at least twice over the single range of motion. This is in contrast to common exercise devices of the prior art that utilize eccentric or cam-shaped pulleys to vary the force in one direction (i.e. an increasing direction) during a single range of motion. There is no oscillation or up and down change in the force magnitude in these prior art devices.

Another term used herein that requires some explanation is "induced perturbations." Perturbations are defined as influences on a system that cause it to deviate slightly. Induced mean that the perturbations are generated by the system, and not by the user. For instance, research has been ongoing into the effect of performing exercises while standing on a vibrating platform. While this undoubtedly influences the outcome of the particular exercise, it is not generated by the system, e.g., a PD2 machine. Instead, the position of the user on the platform means that the vibrations essentially come from the user, much as if he/she simply moved from side-to-side while working out. The present invention relates to exercise systems that have contact members that can be moved against a resistive force. The systems of the present invention "induce perturbations" in the resistive force, such as by oscillating the magnitude or direction of the force vector; i.e., they force the resistance to be throw off not just in magnitude but in direction multiple times, preferably as non-repeating events.

Figure 1:
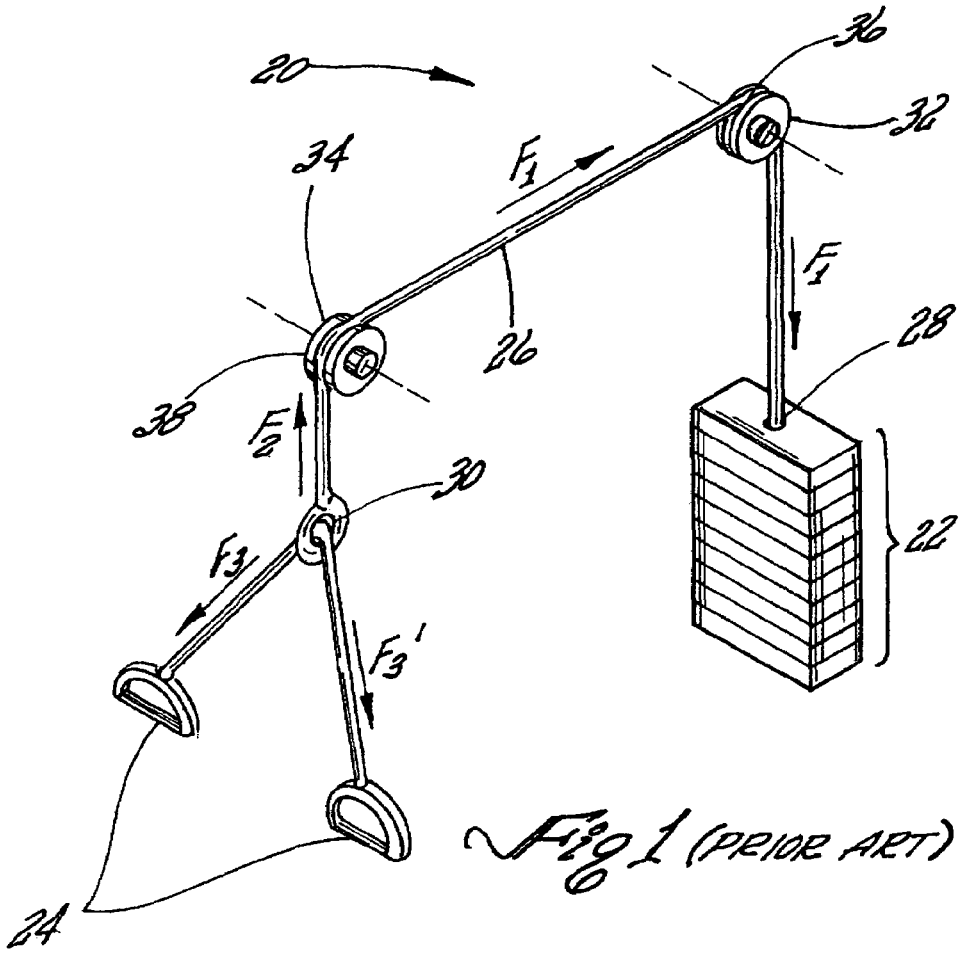
Fig 1 (PRIOR ART)
FIG. 1 is a perspective view showing the movable portions of a pull-down/press-down type of exercise device in accordance with the prior art.

Turning now to FIG. 1, a pull-down/press-down (PD2) device in accordance with the prior art is indicated in perspective view at numeral 20. For simplicity, only the moving parts of the PD2 device 20 are shown. In the device 20, a weight stack 22 is in mechanical connection to a handgrip 24 by means of a transmission including a cable 26. The cable has a trailing end 28 attached to the weight stack 22 and a free or leading end 30 attached to the handgrip 24. The handgrip 24 may be a pair of handles connected to the leading end 30 of the cable by means of ropes or loops as shown, or it may comprise a bar, or similar grasping means. The cable 26 is supported by a rear pulley 32 and a lead pulley 34; that is the cable traverses and is guided by both pulleys. The term "lead pulley" as used in the discussion of PD2 devices to follow, refers to the pulley supporting the cable that is closest to the leading end 30 of the cable 26.

If the rear pulley 32 has a circular groove 36, the reaction or resistive force $F_1$ to movement of the handgrip 24 (a directional arrow in FIG. 1) will be equal to the weight of the weight stack 22 oriented in the direction of the corresponding arrow. If the lead pulley 34 also has a circular groove 38, the resistive force vector $F_2$ transmitted from the lead pulley 34 to the handgrip 24 will be equal to $F_1$ in magnitude. To lift the weight stack 22, the user must apply a force to the handgrip 24 greater than $F_2$. In the configuration shown where the handgrip 24 splits into two handles, the sum of the projections of applied force vectors $F_3$ and $F_3'$ along the axis defined by $F_2$ must be greater than the resistive force $F_2$ to lift the weight stack 22. When the applied forces $F_3$ and $F_3'$ are relaxed, so the sum of the projections of $F_3$ and $F_3'$ along the axis defined by $F_2$ becomes less than $F_2$, the weight stack returns to its original position until either the applied force $F_3$ and $F_3'$ is reapplied, or it comes to rest on a support such as a floor (not shown).

Figure 2:
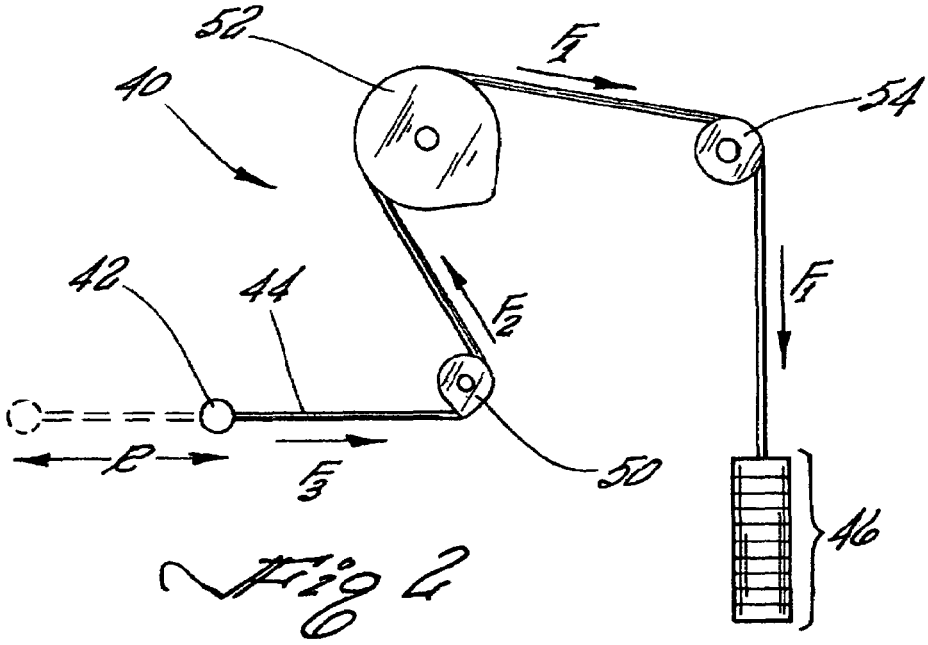
FIG. 2 is a schematic side view of a pull-down/press-down exercise device in accordance with one embodiment of the present invention employing a cam-like lead pulley having a smaller circumference than a preceding cam-like pulley wherein the magnitude of the resistive force $F_3$ oscillates throughout the range of motion R during a repetition of the exercise.

FIG. 2 is a schematic diagram of a pull-down/press-down (PD2) exercise device 40 in accordance with a double cam-pulley embodiment of the present invention. The exercise device 40 is similar in operation to the basic PD2 device 20 of the prior art shown in FIG. 1 in that the user pulls a handgrip 42 connected to a cable 44 forming a part of a flexible transmission that ultimately lifts a weight stack 46. The cable 44 acts as the mechanical connection that the tensile force from the weight stack 46 along a resistive force vector in opposition to movement of the handgrip 42. Instead of a series of the circular pulleys, however, the transmission of the device 40 employs a cam-like lead pulley 50 having a smaller circumference than a preceding cam-like pulley 52, as well as a standard circular pulley 54 that is closest to the weight stack 46. The cable 44 is supported by the pulleys 52, 54. Upon movement of the handgrip 42 within a range of motion R, the magnitude of the resistive force $F_3$ oscillates during a repetition of the exercise by virtue of the cam-shaped pulleys 50, 52. Any non-circular lead pulley may be used to fluctuate or induce perturbations in the resistive force magnitude.

It should be understood that the cam-shaped pulleys 50, 52 function differently than traditional "Nautilus-style" eccentric pulleys. Specifically, the cable 44 traverses over or passes around each of the pulleys 50, 52 rather than being connected thereto. In a standard Nautilus-style device, the cable terminates at a specific attachment point around the circumference of the eccentric pulley which therefore cannot be rotated even 360°. The principle behind such Nautilus-style eccentric pulleys is to increase or decrease the resistive force in one direction only during a single range of motion of a contact member. So for instance when performing an arm curl with a Nautilus machine the effort required to begin an arm curl where the arm's leverage is at a minimum is approximately equal to the effort required at the end where there is greater leverage.

In contrast, both of the cam-shaped pulleys 50, 52 contribute to the varying resistance which may go up or down, or both, and preferably oscillates during the range of motion R. Indeed, the resistance curve of a particular machine set up for arm curls might begin with one force which first decreases during the range of motion. The key difference is the use of a cam-shaped lead pulley 50, or an in-line pulley 52 over which the cable 44 traverses rather than to which it is fixed.

Figure 3:
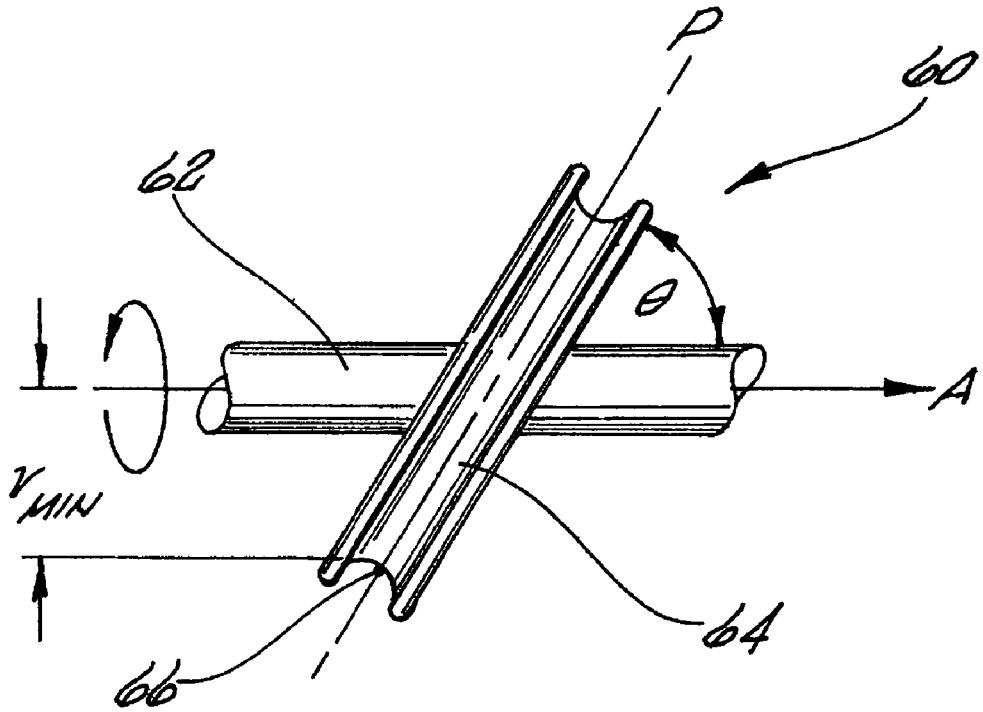
FIG. 3 is a front view of a lead pulley suitable for use with a PD2-type of exercise device to cause the direction of the resistive force to oscillate wherein the plane of the lead pulley is tilted with respect to its axis of rotation.

In the PD2 device 40 of FIG. 2, the lead pulley 34 may be cam-shaped and orthogonally mounted on its rotational axis as shown or it may be tilted on its rotational axis. For instance, FIG. 3 is a front view of a lead pulley 60 suitable for use with a PD2-type of exercise device such as that shown at 40 in FIG. 2 that operates to cause the direction of a component of the resistive force to oscillate. Specifically, the plane P of the lead pulley 60 is tilted by an angle θ with respect to its axis of rotation A, centered for instance about a shaft 62. It should be understood that the plane P of pulley 60 is defined in this case by the plane of the groove 64 that receives the cable in the exercise device transmission.

In the orientation illustrated in FIG. 3, a lower generatrix 66 of the rotating pulley 60 will oscillate left to right. If the pulley 60 is utilized in the exercise device 40 of FIG. 2, it will be understood that the user will experience a corresponding left to right oscillatory movement of the cable 44 because it is guided by the lower generatrix 66 of the pulley 60. In other words, the direction or vector of the resistive force $F_3$ will oscillate left to right and induce perturbations in the "felt" resistive force. It will be understood by the reader that the cable may extend toward the operator from other than the bottom of the lead pulley, and the cable guide portion defined by the lower generatrix 66 is merely representative of the configuration shown in FIG. 2. That is, depending on the particular exercise machine, the resistive force vector may project horizontally, vertically downward, diagonally, etc. to affect a desired muscle/muscles.

A circular pulley 60 may also vary the magnitude of the resistive force by virtue of its mounting orientation. Namely, if the plane of the lead pulley 60 is tilted with respect to its rotational axis A, the magnitude of the resistive force $F_3$ will further have an oscillating component. FIG. 3 shows the distance $r_{min}$ between the lower generatrix 66 and the rotational axis A of the pulley 60. As the pulley 60 rotates from its illustrated position, the lower generatrix 66 will swing to the right but will also extend farther away from the axis A. At 90° from the orientation shown, the generatrix 66 will be at its lowermost point, which is equal to the radius r of the groove 64. Rotating another 90°, the generatrix 66 will have swung all the way to the right and again be spaced a distance $r_{min}$ from the axis A. As the cable traverses the oscillating pulley 60 the moment arm changes as the generatrix 66 moves toward and away from the axis A, which also changes the resistance force $F_3$ transmitted by the cable. Mathematically, the moment arm varies between a maximum of the radius r of the pulley groove 64 and $r_{min}$, where $r_{min}=r \sin \theta$. Furthermore, in addition to being tilted, the lead pulley 60 may also be cam-shaped such as the lead pulley 50 in FIG. 2 to provide even greater oscillatory changes in both the direction and the magnitude of the resistive force $F_3$ during a single repetition.

Figure 4:
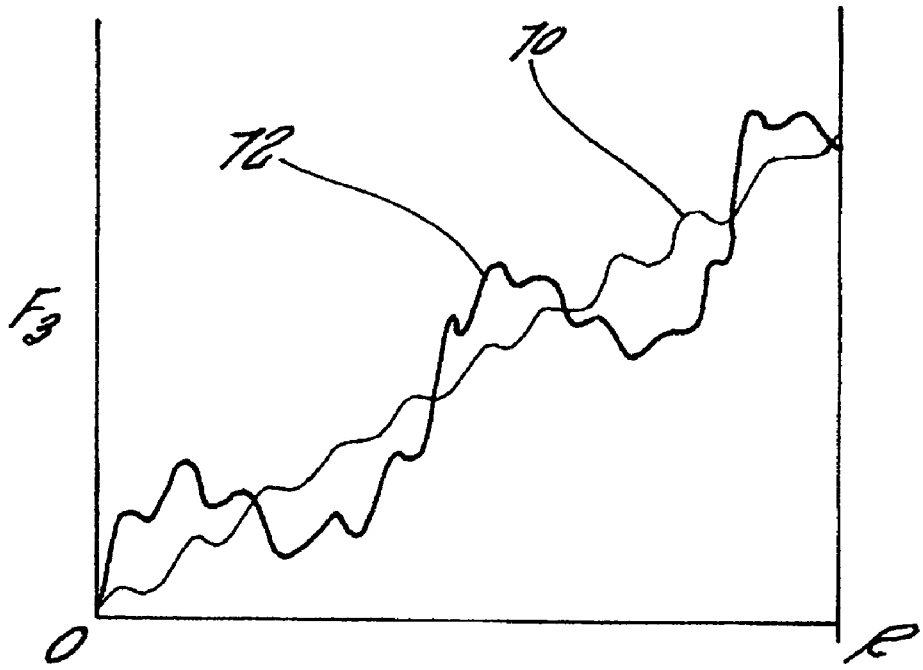
FIG. 4 is an exemplary graphical representation showing the change in the resistive force $F_3$ throughout the range of motion R for the embodiment of the invention illustrated in FIG. 2.

FIG. 4 is a graphical representation showing an exemplary pattern 70 of the resistive force $F_3$ throughout the range of motion R for one configuration of the exercise device 40 illustrated in FIG. 2. The overall magnitude of the resistive force $F_3$ increases in a linear fashion along the range of motion, though it oscillates due to the configuration of the lead pulley 50. For example, the cam-shaped lead pulley 50 such as shown in FIG. 2 will create the oscillating force magnitude. The gradual linear increase in the overall resistive force $F_3$ may be provided by the larger cam-shaped pulley 52, which may be designed to rotate less than one full revolution during the range of motion R. Or, alternatively the cable 44 may terminate at a conventional eccentric Nautilus-style pulley (not shown). Still further, other means for gradually increasing the resistive force may be incorporated into the exercise device 40, such as an elastic band system or a programmable device having a gradually increasing cable braking or tensioning system.

Alternatively, a pattern 72 of the change in the resistive force $F_3$ having superimposed long and short wavelengths may be created using the combination of two cam-shaped pulleys 50, 52, both of which rotate more than once during the range of motion R. Those of skill in the art will understand from FIG. 4 the infinite variety of possible resistive force patterns that can be created through the combination of different pulleys in the cable transmission system. Is also important at this point to emphasize that the change in the pattern of resistive force can be generated by other transmission systems than the cable/pulley transmissions disclosed, and the invention should not be considered limited thereto.

The following general mechanical principles help illustrate the benefits of the present invention:

force=mass×acceleration;

work=force×distance;

power=work per unit of time.

With reference to the graph of FIG. 4, the work done by a user experiencing the exemplary resistive force patterns 70, 72 may be more or less than that done by a user facing a simple linearly increasing force. However, the impact on the muscle groups used in the particular exercise is quite different. The term "non-contiguous muscular innervation" means that a muscle is either fully contracted or not contracted at all. For instance, since the muscle fibers that make up the hamstring run vertically the entire length of the muscle group, one cannot isolate the upper or lower regions of the hamstrings. The reader will therefore understand that when undertaking the exercise represented by the resistive force pattern 70, the muscle group affected is subjected to rapidly oscillating increases and decreases in force, with the average force increasing in a linear manner. This oscillation or vibration "innervates" the entire length of the muscle, and thus there is alternating contraction and relaxation of the muscle group during the range of motion. With a conventional linearly increasing resistive force, the muscle contracts and is gradually subjected to a greater force without let up.

Moreover, the oscillations in the graph of FIG. 4 may also be representative of cyclical changes in direction of the resistive force, not just the magnitude. In that case, because the distance traveled by the contact member manipulated by the user is greater than if the force direction did not oscillate, the work done per repetition is greater because of the equation work=force×distance.

The oscillations in the graph of FIG. 4 may also be representative of the cyclical changes in the magnitude as well as the direction of the resistive force. In the case where the force magnitude oscillates upward from a baseline magnitude, the total of the resistance worked against is greater than if the resistive force did not vary from the baseline. The combined increase in the resistive force magnitude and distance results in substantially more work performed.

There are two primary factors when exercising with resistance. The resistance (or force magnitude) and the distance that the resistance travels. If one takes an increment of this exercise, anywhere along this path, the present invention forces fluxion of both distance and resistance within this small portion, not through the broad sweeping of the range of motion. It is believed that this will force the body to respond in ways as of yet unstudied. Prior exercise equipment merely effect the distance that the resistance travels, as in increasing the sweeping motion of the range of motion, but not incremental increases and decreases of the resistance element or the incremental distance traveled through left to right undulations within these small increments. Systems incorporating the principles of the present invention exhibit undulating motions on a much smaller scale and implement these small changes to effect the collective whole of the exercise.

Combining the oscillating magnitude and direction of resistive force provides even greater benefit. One particularly advantageous feature of the present invention is the ability to innervate a muscle over a relatively small range of motion. Consequently, those users who have a degraded or limited range of motion because of some physical disability experience a much more comprehensive workout even with small movements. A specific example would be to incorporate a tilted pulley as a lead pulley in a standard PD2 device so that both the force and the distant oscillates during the entire range of motion. If the user can only displace the contact member one quarter of the possible range of motion, the oscillations provide an enhanced workout over an exercise device that has a linear or gradually increasing response.

Still further, the present invention is believed to provide one solution to detrimental effects of zero gravity during spaceflight. It is well known that the lack of gravity in spaced leads to rapid muscular atrophy or weakening. Various solutions have been proposed, but the present invention is believed to enhance an otherwise simple workout to such an extent that it will be adopted for spaceflight. If the range of muscles utilized and the amount of work performed during a simple arm curl can be increased, then an entire body workout utilizing various configurations of the present invention may greatly mitigate the adverse effects of zero gravity. By increasing/decreasing the workload (resistance) multiple times throughout the range of motion and/or changing the direction of the workload (resistance) projection, the exerciser is able to provide continuously changing forces (induced perturbations) on their musculature.

Figure 5:
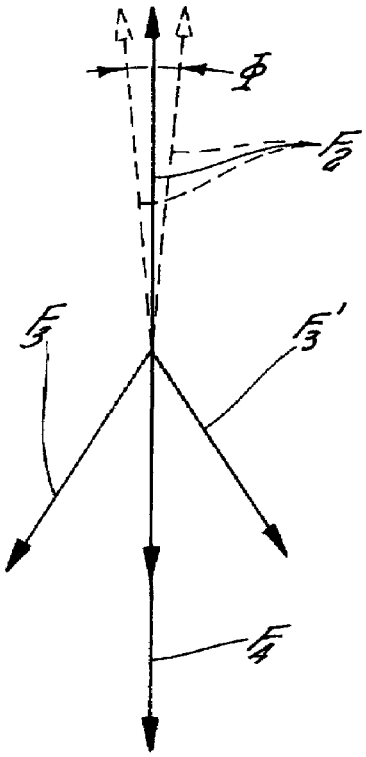
FIG. 5 schematic represents the resistive force vector provided by a pull-down/press-down type of exercise device and the contractile force vectors applied by an exerciser that is required to overcome the resistive force vector.

To help in a more general understanding of the oscillating resistive force, FIG. 5 is a simple force diagram that can be related to the exercise device 40 of FIG. 2. The lead pulley 50 in FIG. 2 may be modified such that when it rotates as the cable 44 passes thereover it changes the direction of the resistive force, or in other words displaces the vector $F_2$ through an angle $\Phi$. The force vectors $F_3$ and $F_3'$ applied by an exerciser using a split handgrip provide a resultant force vector $F_4$, which must have a magnitude greater than the resistive force vector $F_2$ in a direction opposite thereto to lift the connected weight stack (not shown). As the direction of $F_2$ changes (shown in phantom) due to the displacement of the cable through an angle $\Phi$, the respective projections of $F_3$ and $F_3'$ along the axis defined by the shifted direction of $F_2$ will also change. The applied forces $F_3$ and $F_3'$ must be changed by the exerciser in order to adapt to the fluctuating direction of $F_2$. Namely, in order to adapt to the fluctuating (oscillating) direction of $F_2$ during a repetition, the exerciser will need to contract a greater range of muscles than is required with a constant $F_2$. Moreover, the relative contribution of the applied forces $F_3$ and $F_3'$ will be unequal and oscillate back and forth. Even with a single handgrip, the direction of the resistive force vector $F_2$ necessitates the utilization of different muscles as the cable oscillates laterally.

Figure 6:
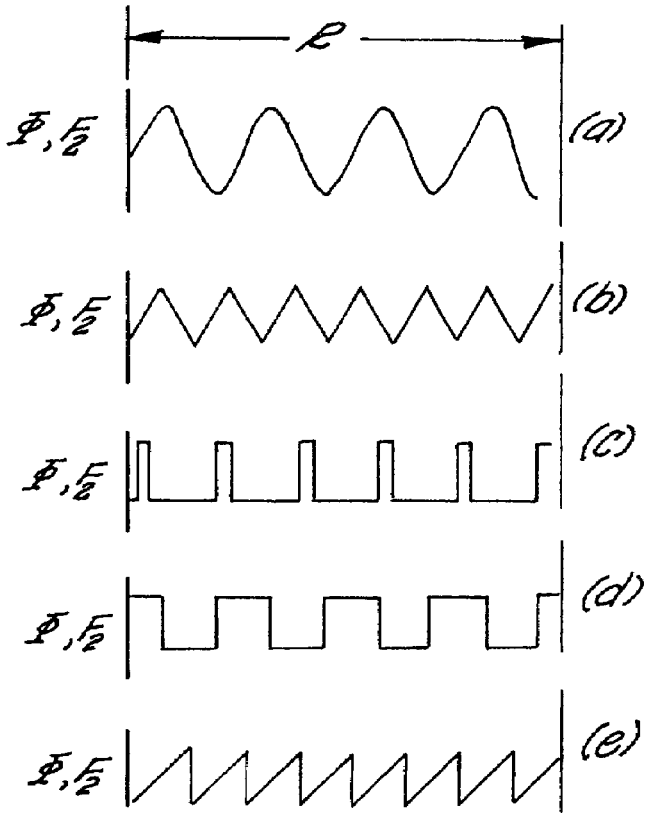
FIGS. 6(*a*)-6(*e*) are graphic representations illustrating examples of some of the possible oscillations in the magnitude $F_2$ and/or the direction $\Phi$ of the resistive force vector during a single repetition in accordance with the present method. The range of motion during the repetition begins on the left and terminates on the right.

The angle of displacement $\Phi$ and the magnitude of $F_2$ can be made to oscillate in a variety of ways during a single repetition. Some examples of the change in magnitude and/or direction of $F_2$ that are possible with particular lead pulley constructions, as will be discussed below, are shown in FIGS. 6(*a*)-6(*e*). FIG. 6(*a*) illustrates a sinusoidal fluctuation in either the magnitude or direction (or both) of $F_2$ that occur during a single repetition. FIG. 6(*b*) shows sawtooth fluctuations. FIG. 6(*c*) illustrates a train of narrow pulses whereas FIG. 6(*d*) illustrates a square wave. FIG. 6(*e*) shows a modified sawtooth fluctuation in the magnitude and/or direction of $F_2$ during a single repetition. Also, the oscillating means (e.g., pulley shape) may be designed to induce combinations of any of these patterns within one range of motion.

It is most important to understand that these oscillations or fluctuations occur during a single repetition, or range of motion R. For instance, FIG. 6(*a*) illustrates oscillating magnitude and/or directions which have four relative minimum and maximum values during a single repetition. FIG. 6(*b*) shows a pattern having at least six relative minimum and maximum values. Although the oscillating resistive forces may, in one embodiment, be generated by eccentric- or cam-shaped pulleys, such pulleys in the prior art have only been utilized to vary the magnitude of the resistive force in one direction, either increasing or decreasing, during a single repetition. Indeed, free rotation of the devices are physically limited by an attachment of the terminal end of the flexible transmission such as the cable directly to the pulley. In contrast, the flexible transmissions of the present invention traverse over the pulleys and therefore their free rotation is not similarly limited.

Although mechanical design of the lead pulley is a simple effective means for accomplishing such changes, various means such as mechanical, hydraulic or pneumatic devices may be employed to vary the direction and/or magnitude of the resistive force $F_2$ in an oscillatory manner over a plurality of cycles during a repetition. Varying baffles, shifting internal rings, and/or pressure sensitive valves are all means for modulating the resistance magnitude or direction, and may all be actuated pneumatically to alternate throughout the range of motion. This resistance modulation, when communicated to a flexible or rigid member or handle with oscillating bearing described herein are examples of means for implementing the present invention.

Up to now, several pulleys have been described to cause oscillatory changes in the magnitude and/or direction of the resistive force experienced by the user. These pulleys have been conventional flat, disk-shaped type of pulleys with outer grooves. The change in direction of the resistive force vector has been provided by tilting the disk-type pulley about its rotational axis. However, there are number of other configurations of pulleys that will result in similar force oscillations, as shown in the examples of FIGS. 7A-7C.

Figure 7A:
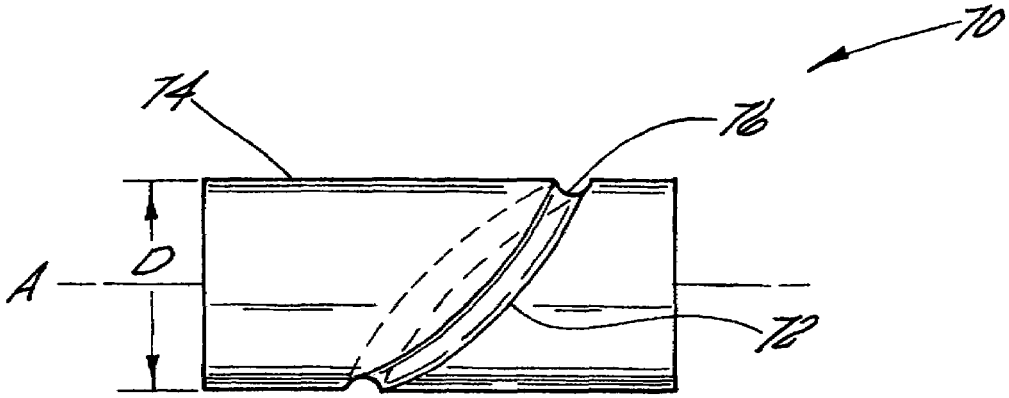
FIG. 7A is an elevational side view of an angular oscillation lead pulley in accordance with an exemplary embodiment of an exercise device of the present invention. The angular oscillation lead pulley is used to cyclically change the direction of the resistive force vector $F_2$ a plurality of times during the performance of a single repetition of exercise.

FIG. 7A is an elevational view of a cylindrical angular oscillation lead pulley 70 in accordance with a preferred embodiment of a PD2 exercise device of the present invention. The pulley 70 may be rotatably mounted and supported on the PD2 device by means of a cylindrical axle (not shown) affixed to the cylindrical member 74 coaxially with the axis of rotation A. The angular oscillation lead pulley 70 is used to cyclically change the direction of the resistive force vector $F_2$ a plurality of times during the performance of a single repetition of exercise. This is accomplished by forming the cable groove 72 in the cylindrical member 74 such that as the cylindrical member turns about its axis of rotation A, the uppermost generatrix 76 of the groove 72, which supports and guides the cable (not shown), travels laterally in an oscillatory manner, returning to its starting position with every complete rotation of the cylindrical member 74. The cylindrical member 74 has a diameter D.

Figure 7B:
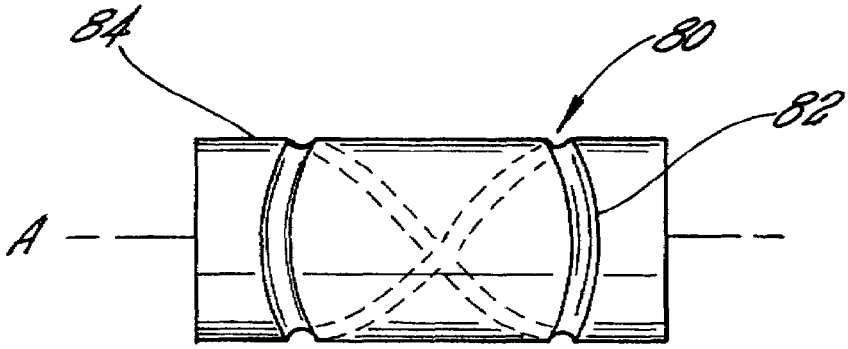
FIG. 7B is an elevational side view of an angular oscillation lead pulley in accordance with another exemplary embodiment of an exercise device of the present invention. The angular oscillation lead pulley is used to cyclically change the direction of the resistive force vector $F_2$ non-uniformly and half as frequently during the performance of a single repetition of exercise than the lead pulley shown in FIG. 7A.
Figure 7C:
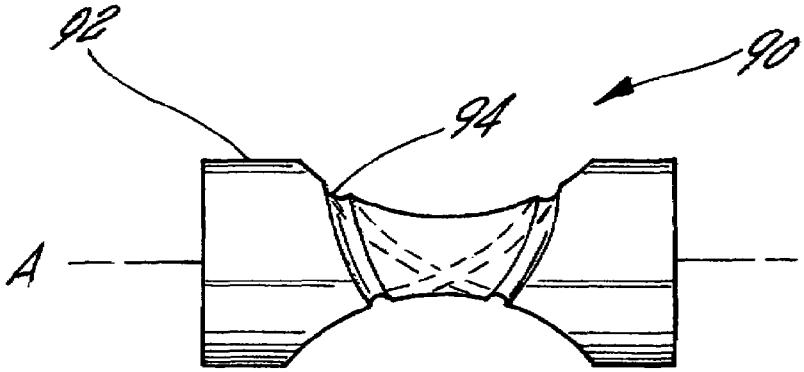
FIG. 7C is an elevational view of a "bowtie" lead pulley in accordance with a second exemplary embodiment of an exercise device of the present invention. The bowtie lead pulley simultaneously changes the leverage and thus the magnitude of $F_2$ and the angular displacement $\Phi$ of the resistive force vector in an oscillatory manner during the performance of a single repetition.

FIG. 7B is an elevational side view of an angular oscillation lead pulley 80 in accordance with another preferred embodiment of an exercise device of the present invention wherein a crossing groove pattern 82 is formed in a cylindrical member 84. The angular oscillation lead pulley 80 is used to cyclically change the direction of the resistive force vector $F_2$ irregularly and half as frequently during the performance of a single repetition of exercise than the lead pulley 70 shown in FIG. 7A.

The lead pulley designs presented above are suitable for providing a resistive force $F_2$ that oscillates in direction during the performance of an exercise repetition. FIG. 7C is an elevational view of a "bowtie" lead pulley in accordance with another embodiment of an exercise device of the present invention in which both the magnitude and direction of resistive force oscillates. The bowtie lead pulley 90 has a variable diameter D over the portion of the cylindrical member 92 traversed by the groove 94, and simultaneously changes the leverage and thus the magnitude of $F_2$ and the angular displacement $\Phi$ of the resistive force vector in an oscillatory manner during the performance of a single repetition.

The frequency of oscillation of the magnitude and/or direction of the resistive force $F_2$ depends upon the particular lead pulley design and the speed at which the lead pulley rotates about the rotational axis A during the performance of a repetition. The number of cycles in the change of direction and/or magnitude in the resistive force $F_2$ that occurs during a repetition depends on the number of rotations the lead pulley makes during a repetition. It is obvious that for a lead pulley having the groove design illustrated in FIGS. 7A-7C, a cylindrical member 74 having a small diameter D will provide more oscillations during a repetition than a lead pulley having a greater diameter D. Accordingly, in accordance with the goal of the present invention, it is desirable to select D such that the lead pulley rotates a plurality of times (i.e., at least twice) during a repetition.

Figure 8:
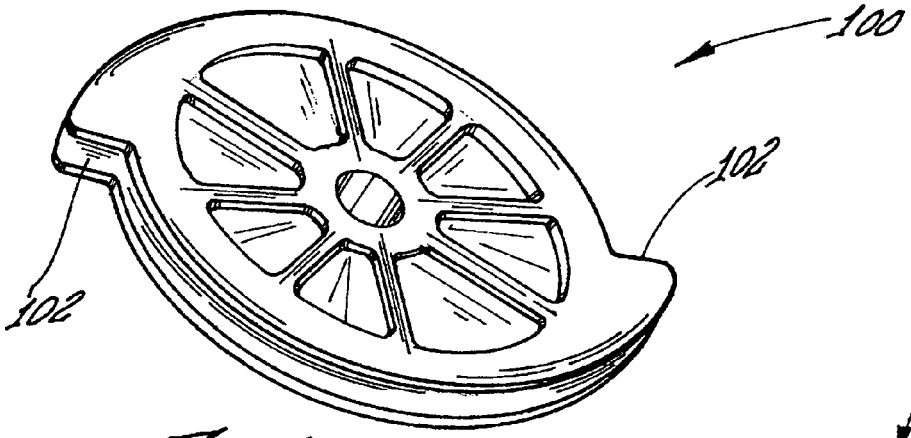
FIG. 8 is a perspective view of a bilobal pulley in accordance with the present invention wherein the axis of rotation of the pulley may be orthogonal or tilted with respect to the plane of the groove in the pulley.
Figure 9:
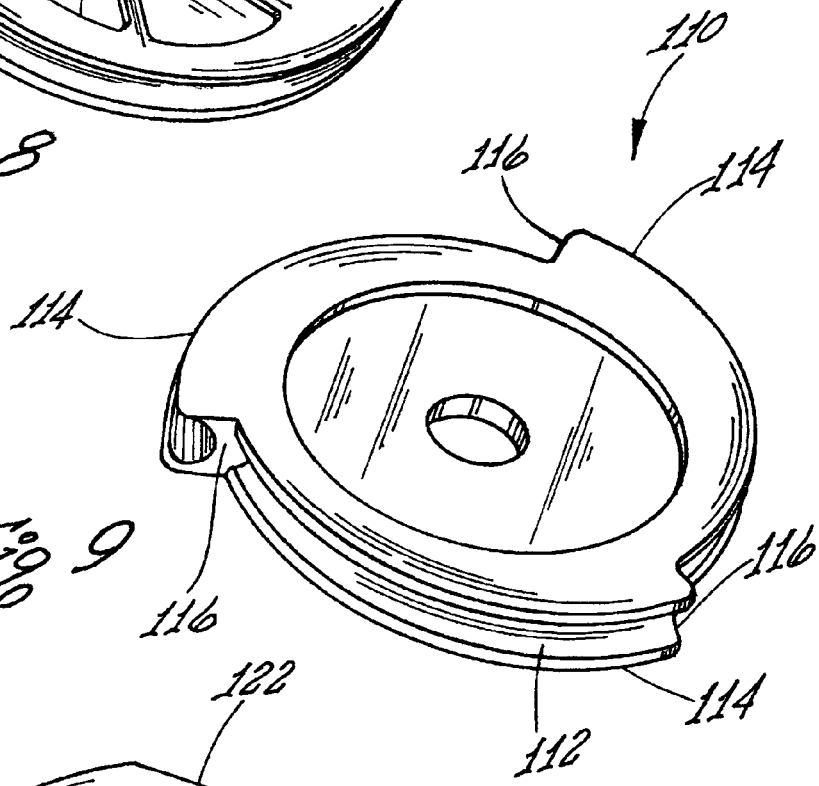
FIG. 9 is a perspective view of a trilobal/stepped pulley in accordance with the present invention wherein the axis of rotation of the pulley may be orthogonal or tilted with respect to the plane of the groove in the pulley.
Figure 10:
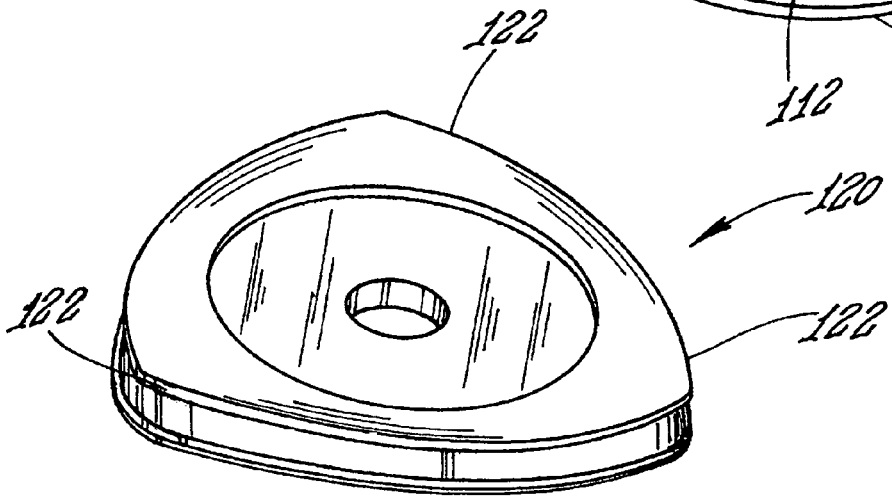
FIG. 10 is a perspective view of a trilobal pulley in accordance with the present invention wherein the axis of rotation of the pulley may be orthogonal or tilted with respect to the plane of the groove in the pulley.

With reference now to FIGS. 8-10, several alternative configurations of lead pulleys in accordance with the present invention are shown.

FIG. 8 illustrates a disk-type bilobal pulley 100 that is generally lenticular in shape but has sudden drop-offs or steps 102 associated with the cable groove therein. Without the steps 102, the pulley 100 with essentially be a bilobal or cam-shaped pulley symmetric about one plane through the central axis. A cable traversing the pulley 100 without the steps 102 would experience a gradually increasing and then decreasing moment arm twice per revolution of the pulley 100. With the steps 102, a discontinuous change in the moment arm is imparted to the pulley 100 twice during each revolution, which necessarily suddenly changes the resistive force transmitted thereto. The pattern of the resistive force thus generated may be something similar to the sawtooth pattern of FIG. 6(*e*).

The performance of the pulley 100 just after the cable passes over one of the steps 102 is akin to a so-called "ballistic" exercise. A ballistic exercise is one in which there is a portion of the exercise in which there is a freefall or temporary lack of resistance to movement. It is at these points of freefall that the muscles being exercised experience little to no resistance until they snap back as the resistance re-engages farther along the range of motion. The muscles experienced this "ballistic" effect at varied points throughout the range of motion. It should be noted that the lesser the number of lobes on the pulley the greater the magnitude variance (e.g., drop) in resistance and, as in this example, the greater the "ballistic" experience. Conversely, a large number of lobes results in many small ballistic events per revolution of the pulley.

FIG. 9 shows a disk-type of pulley 110 having a groove 112 around an outer periphery and defining a plane. Three lobes 114 project outward and terminate in three steps 116 in the groove 112. The steps 116 provide a sudden change in moment arm for a cable within the groove 112, and the accompanying sudden change in resistive force pattern. It will be appreciated by the reader that if a relatively small diameter pulley 110 is utilized as a lead pulley in one of the exercise devices of the present invention the resulting resistive force pattern will oscillate rapidly, and have sudden changes, specifically three times every revolution of the pulley 110.

Finally, FIG. 10 illustrates a third alternative pulley 120 which is trilobal and has three outwardly projecting lobes 122. When utilizing the pulley 120 as a lead pulley, the resistive force imparted to a cable fluctuates three times per revolution. In contrast to the pulley of FIG. 9, there are no sudden steps or drop-offs and instead the moment arm changes relatively continuously. It should be noted that the pulleys shown here are examples only and variations are contemplated. For instance, pulleys may incorporate both smooth lobes and a "ballistic" component. The resistive force response from the pulleys of the present invention need not be uniform or regular, but may be irregular based on irregular points/distances from the mid-point of the pulley. Their size (therefore distance from the mid-point of the pulley), shape and numbers can and will affect the frequency of magnitude fluctuation and the degree/distance of left to right undulations.

Figure 11A:
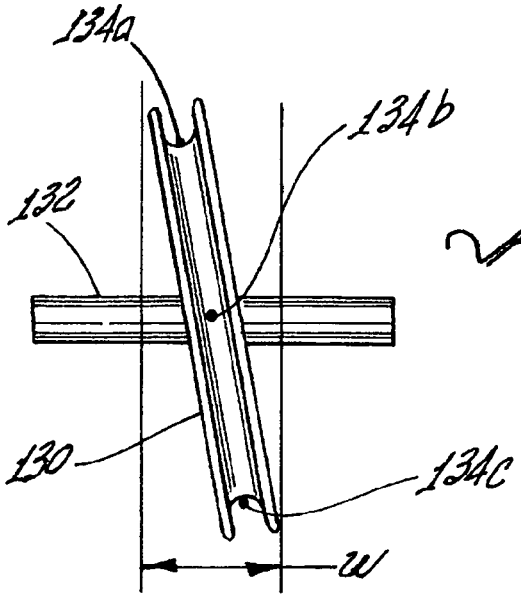
FIG. 11A is a front view of a circular pulley mounted on axle that is tilted with respect to a line orthogonal to the plane of the pulley and illustrating a first orientation of the pulley when the axle is in a first angular position.
Figure 11B:
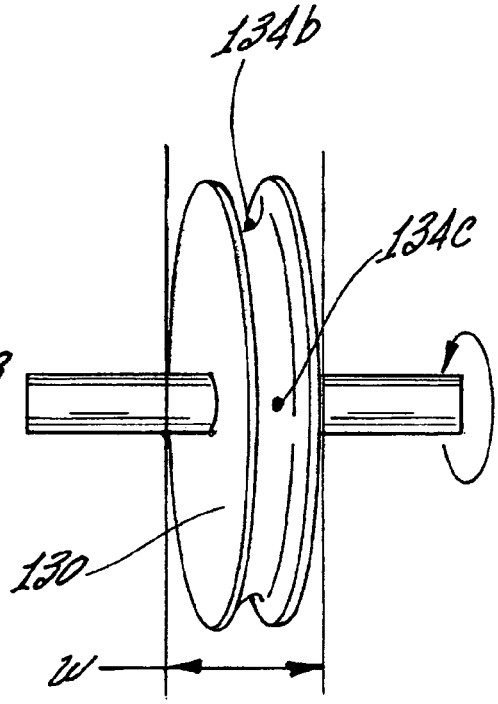
FIG. 11B is a front view of the circular pulley of FIG. 11A illustrating a second orientation of the pulley when the axle is in a second angular position 90° from the first, and illustrating the changed positions of certain points around the pulley.

FIGS. 11A and 11B further illustrate the lateral oscillation of a circular pulley 130 that is mounted at a tilt on a rotating shaft 132. In the orientation of FIG. 11A, three points 134*a*, 134*b*, 134*c* angularly spaced 90° from one another are visible. The uppermost point 134*a* is displaced to the left while the lowermost point 134*c* is tilted to the right. After a rotation of 90° in the direction of the arrow shown in FIG. 11B, only two points 134*b*, 134*c* remain visible. The uppermost generatrix of the groove of the pulley 130 is defined by point 134*b*. Of course, a further rotation of 90° will carry the third point 134*c* to the top. If the pulley 130 forms a lead pulley in an exercise device of the present invention, and the transmission cable extends over the top of the pulley, then one can see that the cable will be guided from its leftmost point in FIG. 11A to its midpoint in FIG. 11B, and over an approximate total wobble distance W.

Figure 12:
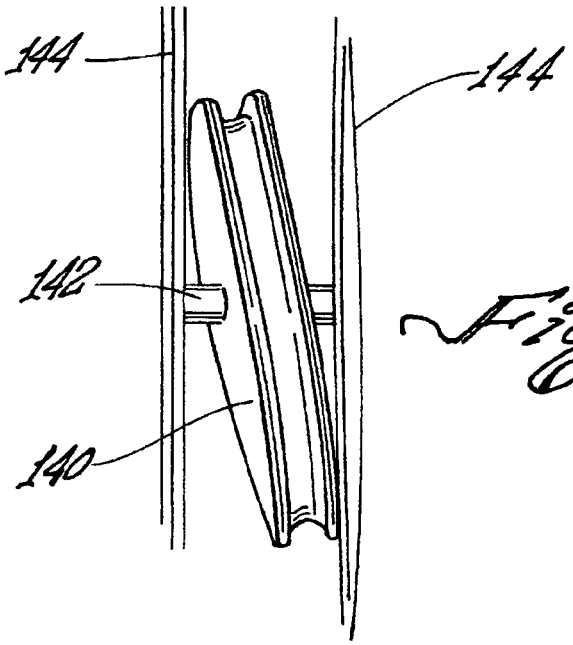
FIG. 12 is a front view of a trilobal pulley mounted on an axle that is tilted with respect to a line orthogonal to the plane of the pulley, and in orientation similar to the circular pulley of FIG. 11A.

FIG. 12 illustrates a trilobal pulley 140 mounted for rotation on or with a shaft 142 in an orientation that is other than orthogonal to the shaft (i.e., at a tilted orientation). The pulley 140 may be utilized as a lead pulley in an exercise device of the present invention, such as the PD2 device 40 schematically shown in FIG. 2. In so doing, both the magnitude and the direction of the resistive force $F_3$ will oscillate throughout the range of motion of the handgrip. FIG. 12 also illustrates a pair of safety walls 144 that may be mounted on either side of the pulley 140 to protect a user from inadvertently being injured by side-to-side movement of the pulley.

It is most important at this stage to emphasize that there are a number of different ways to accomplish oscillating magnitude or direction of a resistive force, other than the primary embodiment described above of a modified lead pulley within a cable or belt transmission. In general terms, a mechanical connection transmits a resistive force from a source of force along a resistive force vector in opposition to movement of a contact member through its range of motion. For example, an exercise machine might include a rigid arm at the end of which is a contact member, such as a foot pedal in a leg press machine or a handgrip(s) at the end of a shoulder or bicep machine. The range of motion of the arm is defined by rotation or translational movement, and is opposed by a resistance transmitted through some form of mechanical connection, such as a pulley/belt arrangement. Various means for oscillating the rigid arm are contemplated, including the provision of a wobbly bearing described below. Another possible configuration is to pivot the rigid arm about a ball and socket so as to have unlimited degrees of freedom, and then guide the movement of the arm so as to oscillate laterally, or perpendicular to the overall direction of motion of the exercise (i.e., left to right if the motion is in a vertical plane). For instance, the arm may be constrained to pass along a serpentine channel which creates the oscillating movement, or may be guided within a linear channel formed in a member that moves side to side under the influence of a prime mover such as a motor or programmed piston/cylinder arrangement. These alternatives are not described in greater detail herein though it is expected that one of skill in the art will understand how to create lateral movement within the moving part of an exercise device.

As mentioned, one means for generating side to side movement of either a rigid arm or the lead pulleys described above is to mount them for rotation about a wobbly bearing. Such bearings are typically anathema to durable and vibration-free rotational support, but in the present application such bearings are ideal to create the oscillating direction of a resistive force experienced by a user of an exercise device. Again, it should be understood that the exemplary wobbly bearing described below is merely one possible configuration.

A preferred "wobbly" spherical bearing 150 is shown in FIGS. 13-20. Conventional spherical bearings have a capacity to carry high loads, tolerate shock loads, and are self aligning. As they can tolerate limited speeds, spherical bearings are used in vibrators, shakers, conveyors, speed reducers, transmissions, and other heavy machinery. Spherical ball bearings are made in varying radial thickness and axial widths to accommodate different loads. Spherical plain bearings can accommodate a shaft or rod with varying misalignment. Unlike a load slot bearing, there is no loss of bearing area due to the entry slot. The ball is typically a copper alloy. Like a load slot bearing, the race is fully machined, wear surface hardened, then finished with a lap operation. Because the race is the harder member, wear is intended to occur on the ball.

Figure 13:
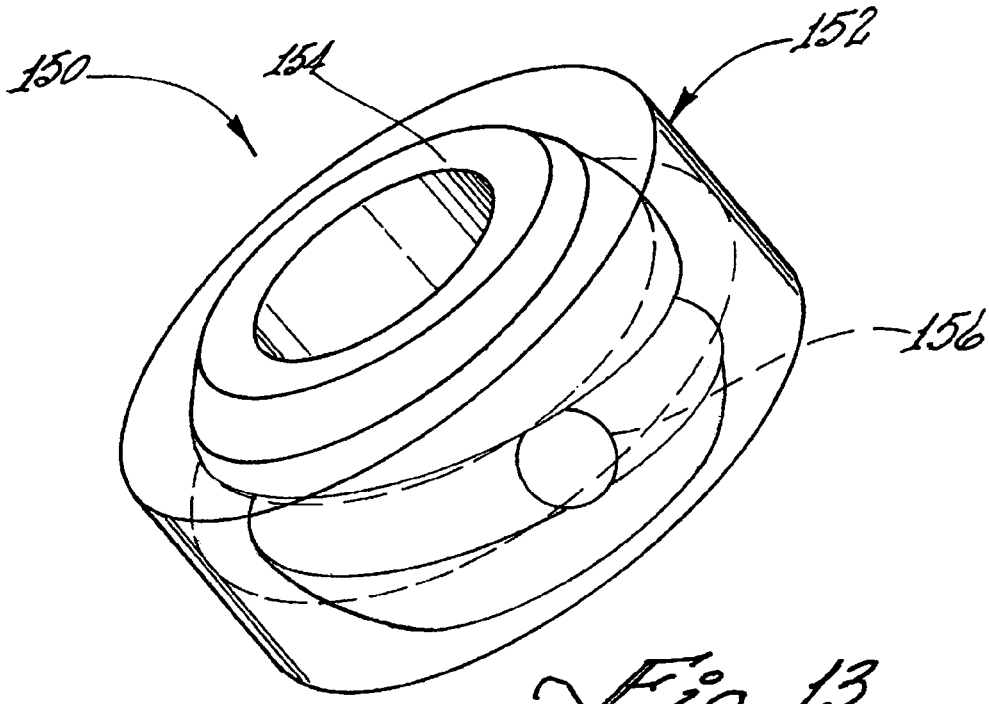
FIG. 13 is a perspective assembled view of an exemplary guided spherical bearing of the present invention shown transparent so as to illustrate certain internal details.
Figure 14:
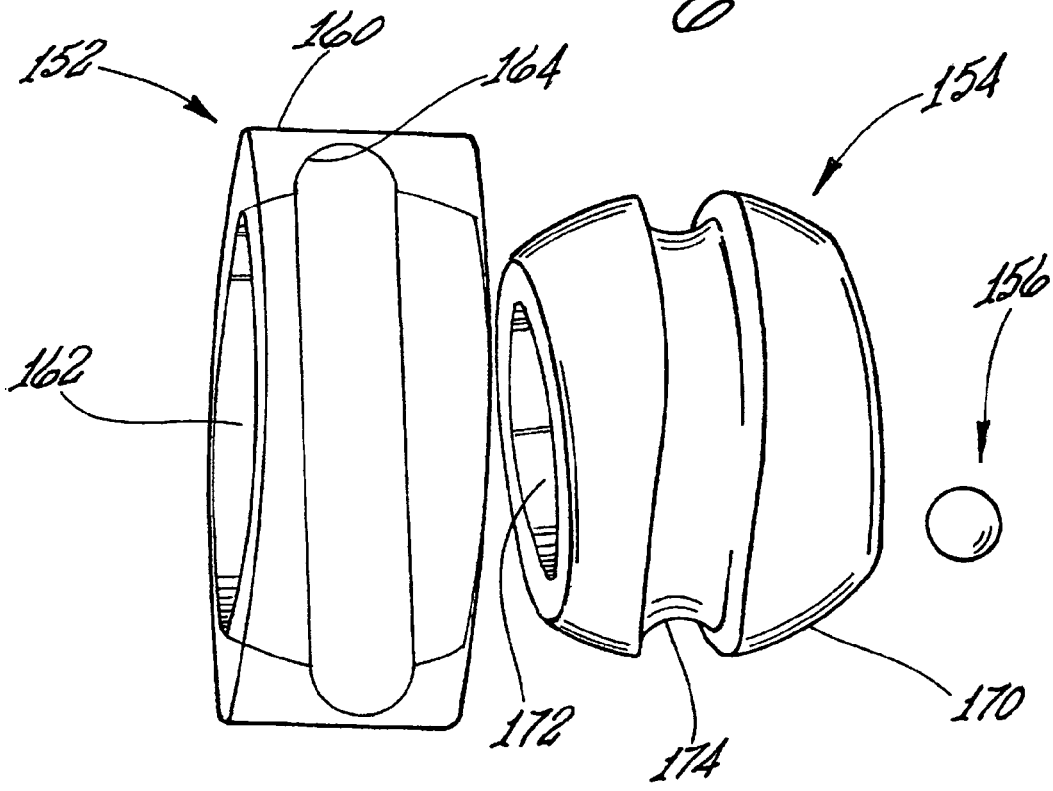
FIG. 14 is a perspective exploded view of the guided spherical bearing of FIG. 13.
Figure 15:
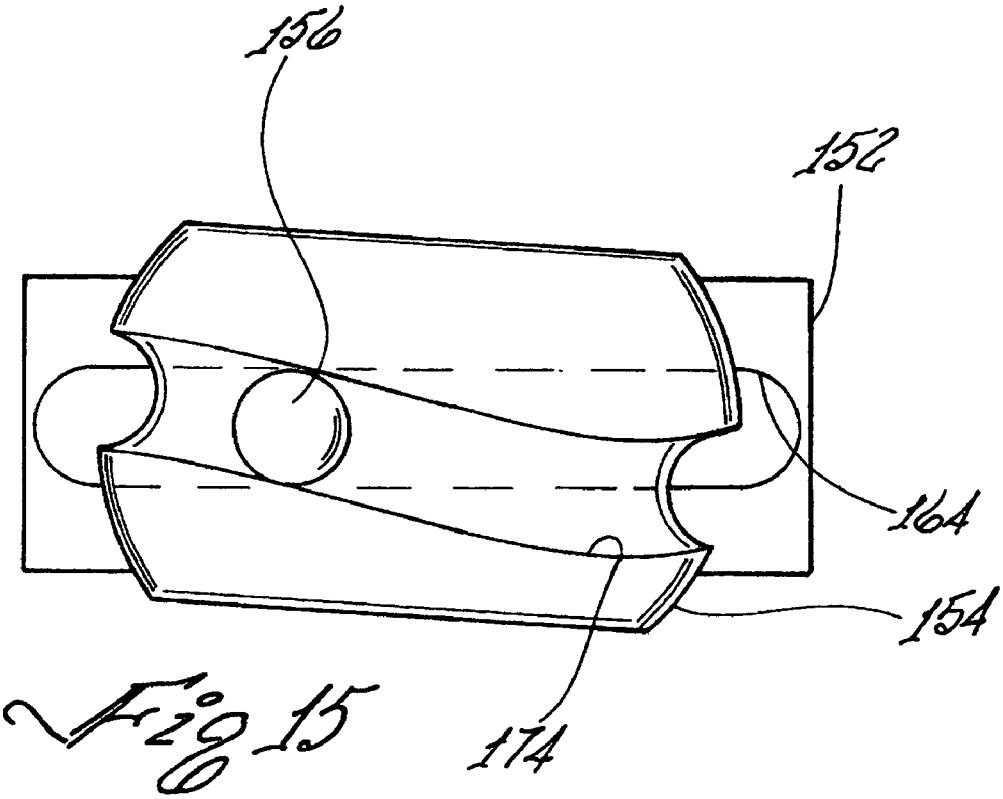
FIG. 15 is an elevational view of one embodiment of a guided spherical bearing of the present invention.

Desirably, a "guided" spherical bearing 150 provides the oscillations or wobbles in the lead pulley or in a rigid arm mounted for rotation thereon. A guided bearing is one that that changes the orientation of the plane of a pulley groove as the pulley rotates, therefore oscillating the pulley. An exemplary embodiment of the guided bearing 150 is seen in FIGS. 13-14 and includes a ring-shaped outer race 152, a somewhat ball-shaped inner member 154, and a ball 156 disposed therebetween. It should be noted that the illustrations of FIGS. 13-14 show the guided bearing 150 transparent or slightly opaque so as to better illustrate certain internal details.

As with conventional spherical bearings, the outer race 152 is defined by a ring-shaped body having an outer surface 160 and a throughbore defined by an inner concave, preferably spherical, surface 162. An inwardly facing race groove 164 interrupts the inner concave surface 162. The inner member 154 defines an outer convex, preferably spherical, surface 170 and an inner through bore 172. An outwardly facing ball groove 174 interrupts the convex surface 172. The inner member 154 is sized to fit within the throughbore of the outer race 152, and desirably the convex outer surface 170 conforms closely to the concave inner surface 162. The combined tracks or grooves 164, 174 define a cylindrical cavity that receives the ball 156. The inner member of 154 typically mounts on a fixed shaft (not shown) in a conventional manner such that the outer race 152 may rotate thereon. A guided member such as a pulley or rigid exercise arm can then be affixed to the exterior surface 160 of the outer race 152. It should be noted that the outer race surface 160 can, in turn, be convex in shape and configured to accept yet another outer ring and ball bearing and so on. Each successive layer adding randomizing effects to the resulting motion.

As mentioned, the relatively large inner concave surface 162 of the outer race 160 and the outer convex surface 170 of the inner member 154 are spherical and provide the primary bearing surfaces which assume most of the load of the bearing 150 during relative rotation of the two main components. The ball 156 also assumes some radial and lateral load, although the bearing 150 is desirably designed to minimize the load taken by the ball. Optional PTFE (Teflon) liners between the inner member and outer race, or within the facing grooves, minimize friction or provide self-lubrication, and therefore extend the life of the bearings.

The relative angle between the outer race 152 and inner member 154 is "guided" by the travel of the ball in the facing grooves 164, 174. That is, one or both of the grooves 164: 74 define a path around the respective component that does not lie in an orthogonal plane relative to a central axis of that component. For example, in FIG. 14 the inwardly facing groove 164 is shown in a plane tilted at an angle other than orthogonal to a central axis of the outer race 152. Likewise, the outwardly facing groove 174 is shown tracing a curvilinear path around the inner member 154. The juxtaposition of the two grooves 164, 174 can be seen in FIG. 13 with the ball 156 received at a point of intersection of the grooves. It is this point of intersection of the grooves that defines a cylindrical cavity for receiving the ball 156. Indeed, a majority of the grooves 164, 174 may not be aligned at any one moment. It will therefore be understood that the outer race 152 rotates in a wobbly manner dependent on the relative paths of the grooves 164, 174 as constrained by the ball 156.

Any number of "wobbles" per revolution can be set up in the bearing 150 dependent on the interaction between the two grooves 164, 174. For example, in FIG. 15 the inwardly facing groove 164 of the outer race 152 is orthogonal with respect to its central axis, while the outwardly facing groove 174 of the inner member 154 traces a curvilinear path. Ball 156 is shown at the intersection of the two grooves.

Figure 16:
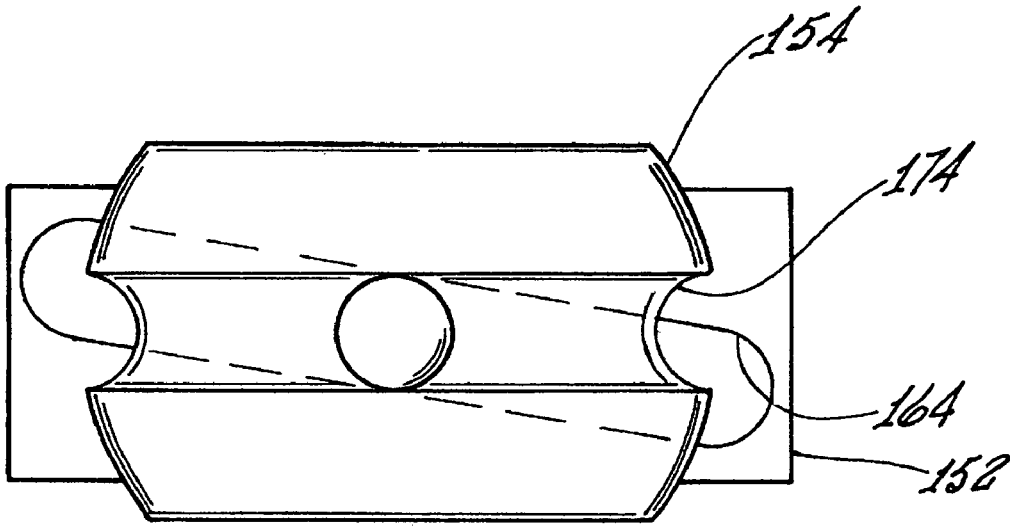
FIG. 16 is an elevational view of another embodiment of the guided spherical bearing of the present invention.

FIG. 16 illustrates another embodiment wherein the outwardly facing groove 174 of the inner member 154 is centrally located in an orthogonal plane relative to the central axis of the inner member. The inwardly facing groove 164 of the outer race 152, on the other hand, lies in a plane which is tilted with respect to the orthogonal plane. The reader will clearly understand that there are numerous variations on these interacting grooves, and in each case the angular orientation of the outer race 152 oscillates as it rotates relative to the inner member 154. Given both a tilted groove 164 matched with a curvilinear groove 174, the variety of oscillatory movement is quite large.

Random oscillation of the resistance force magnitude or direction is also possible with the allowance of a small amount of slippage between the ball 156 and the facing grooves 164, 174. Random movement may also be introduced by adding a second race (not shown) around the outer race 152 in a double-level bearing. Furthermore, if the resistance force is subject to a programmable controller, the oscillations can be randomized or may be presented as a selected number of set patterns. The resistance of an elliptical machine, for instance, can be programmed to gradually change according to the type of workout desired. In a like manner, a controller may be programmed to impart regular, irregular, increasing, decreasing, or random oscillations. Once again, a programmable controller may cooperate with various prime movers for transmitting the particular oscillation to a force transmission system, as is known in the art. For instance, the resistance to rotation of a pulley can be oscillated over a single range of motion in the same way that the resistance to rotation of a flywheel of an elliptical machine is altered periodically.

Figure 17:
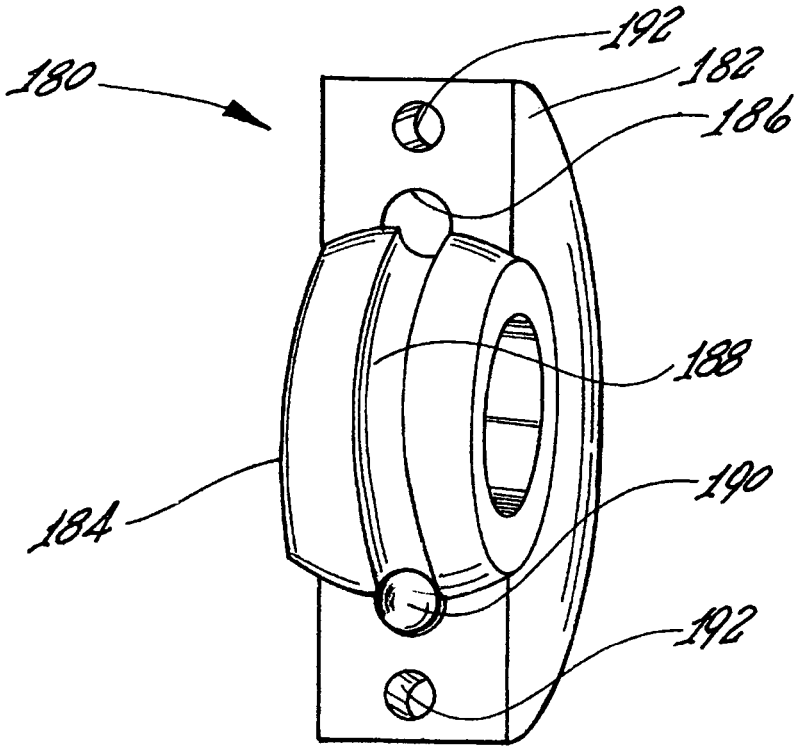
FIG. 17 is a partial sectional view of an alternative guided spherical bearing having a split outer race.

FIG. 17 shows the partial sectional view of one version of a wobbly bearing 180 of the present invention. As before, the bearing 180 includes an outer race 182 that receives a partially spherical inner member 184. Facing grooves 186, 188 intersect and receive a ball 190 in a cavity defined therebetween. Only one half of a split outer race 182 is shown having fastener holes 192 for joining with the other half (not shown). This is one way of assembling the bearing 180, although an alternative construction is a split inner member. The split inner member would be machined and ground in matched sets with a "zero" gap at the separation plane.

It should be noted here that the applications of exemplary guided bearings need not be confined to the application of an exercise machine. For example, the guided bearings may be incorporated into rock crushing machines, electric toothbrushes, electric shavers, etc. Another possible application is in a "swashplate" or wobbly yoke sometimes used in helicopters. It is important therefore to note that the present application, while focusing on exercise machines, presents what is believed to be a novel guided bearing that may be independently claimed.

Figure 18:
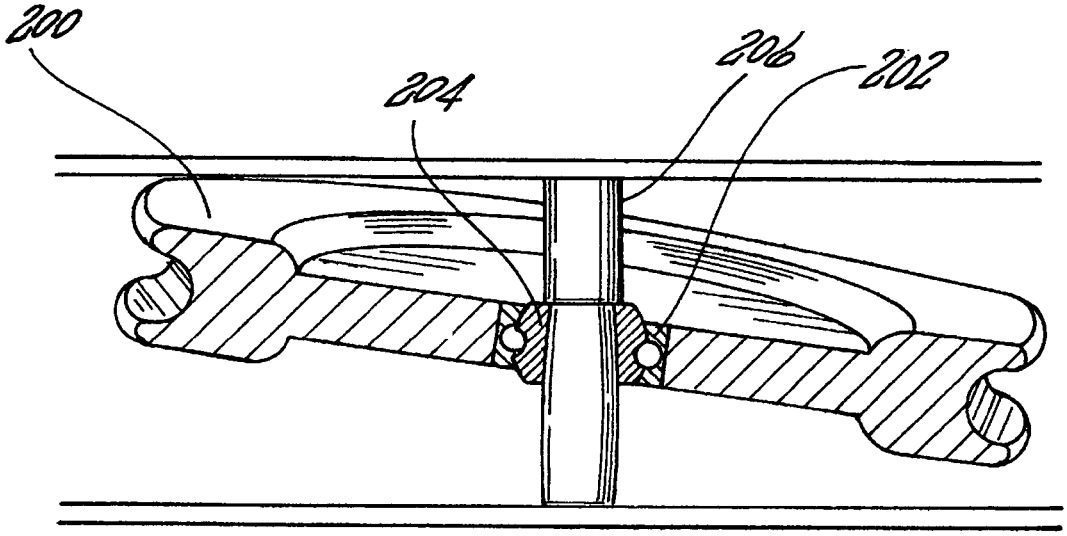
FIG. 18 is a partial sectional view of a lead pulley mounted over a guided spherical bearing of the present invention.

FIG. 18 illustrates a disk-shaped pulley 200 mounted to an exterior surface of an outer race 202 of a wobbly bearing as described herein. The outer race 202 rotates around an inner member 204 that is fixed on a fixed shaft 206. The facing grooves are shown, although not numbered for clarity. As the outer race 202 and attached pulley 200 rotates about the inner member 204 and shaft 206, their angular orientation changes dependent on the relative paths of the facing grooves. The oscillation of the pulley 200 therefore may be designed much like the pulley 130 of FIGS. 11A-11B, or may be a much more complex movement.

Figure 19:
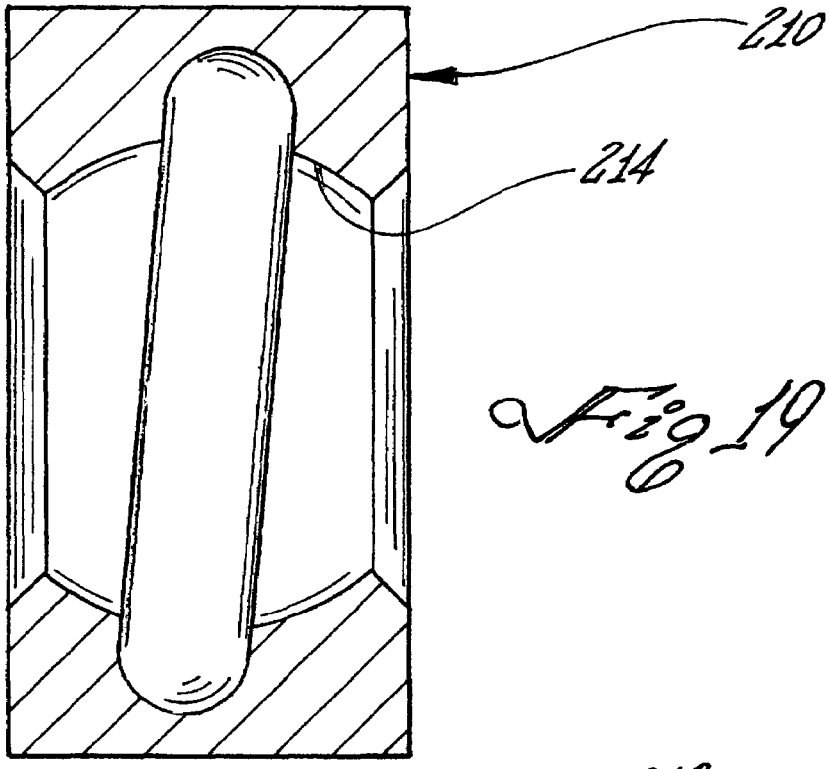
FIGS. 19 and 20 illustrate an outer race and an inner member, respectively, that include features to prevent excessive lateral rotational movement.
Figure 20:
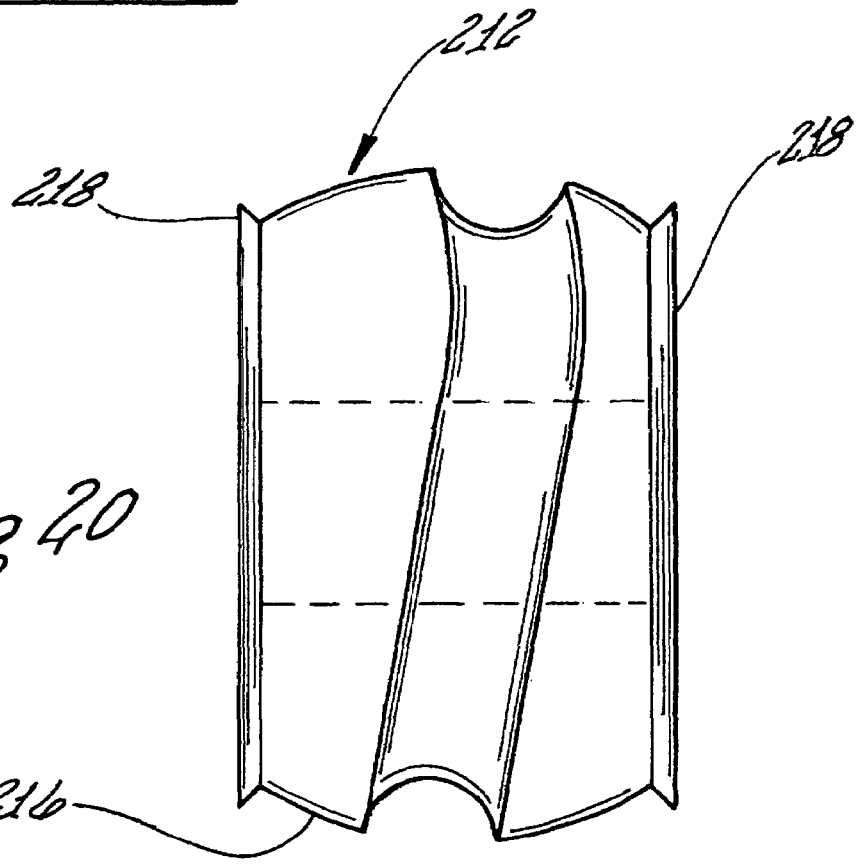

FIGS. 19 and 20 illustrate, respectively, an outer race 210 and an inner member 212 having features preventing excessive relative lateral rotation. As before, the outer race 210 defines an inner concave bearing surface 214 that closely receives an outer convex bearing surface 216 on the inner member 212. The axial dimension of the convex surface 216 is greater than the axial dimension of the concave surface 214, such that a pair of flanges 218 extend on either side of the throughbore of the outer race 210. Some lateral rotation is accommodate, however if lateral loads on the outer race 210, or rotating pulley attached thereto, exceed a predetermined amount, the flanges 218 prevent the outer race 210 from excessive relative lateral rotation. The reader will note that the ball bearing that interacts with the outer race 210 and inner member 212 has been omitted for clarity.

Figure 21A:
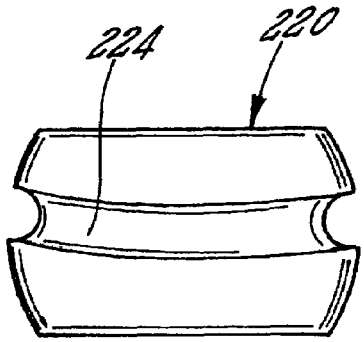
Figure 22A:
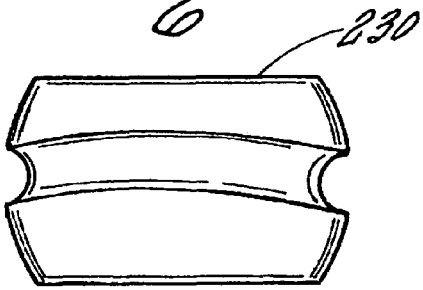
Figure 23A:
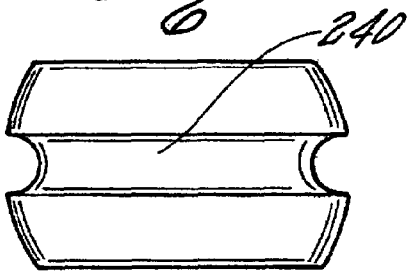

FIGS. 21A, 22A, and 23A illustrate exemplary planar groove patterns for the ball bearing groove of the inner member. Namely, FIG. 21A shows a curvilinear groove 224, FIG. 22A shows a curvilinear groove 230 oriented in the opposite direction, and FIG. 23A shows an orthogonal planar groove 240. Note that these inner member groove patterns can be mixed and matched with any number of various outer race groove patterns to achieve desired/optimal results.

Figure 21B:
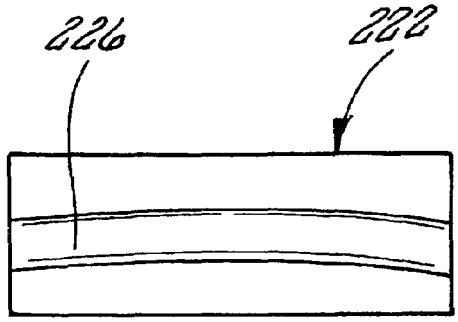
Figure 22B:
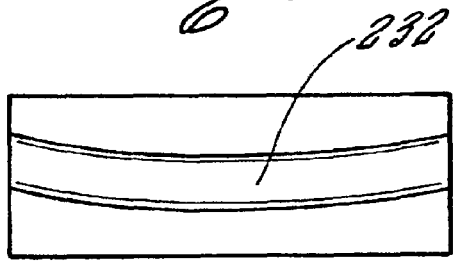
Figure 23B:
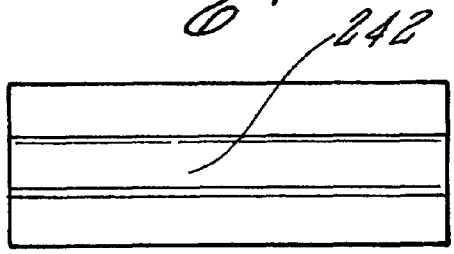

FIGS. 21B, 22B, and 23B illustrate exemplary planar groove patterns for the ball bearing groove of the outer race. Namely, FIG. 21B shows a curvilinear groove 226, FIG. 22B shows a curvilinear groove 232 oriented in the opposite direction, and FIG. 23B shows an orthogonal planar groove 242. Note that these outer race groove paths can be mixed and matched with any number of various inner member groove patterns to achieve desired/optimal results.

The longer the groove pattern (the more curved and/or frequency of curves) on the inner member or outer race, the greater its surface area and therefore the direction or magnitude of left to right undulations and/or their frequency are impacted.

The orthogonal grooves 240, 242 are included to emphasize that the spherical bearing may be of a conventional style without wobbling but may be used for rotationally mounting a non-circular pulley of the present invention.

Figure 24A:
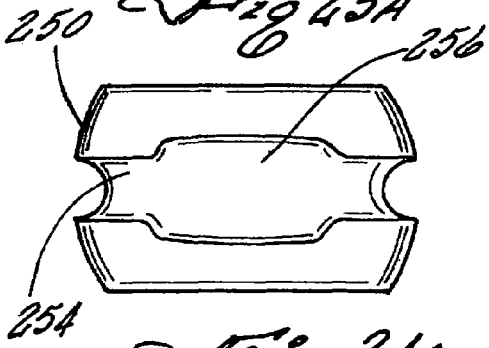
FIGS. 24A and 24B illustrate exemplary groove patterns in an inner member and outer race used in guided spherical bearings of the present invention which permit relative slipping or play, and results in a random resistance response transmitted thereby.
Figure 24B:
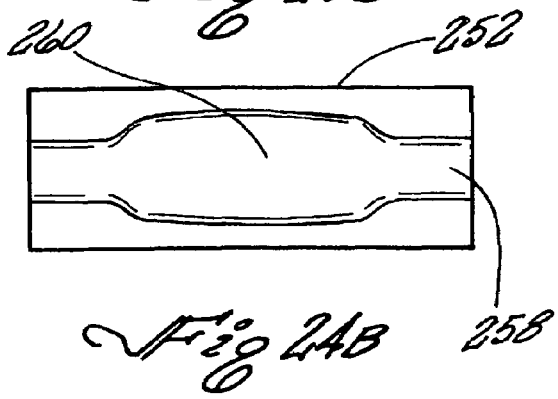

FIGS. 24A-24B illustrate an inner member 250 and outer race 252. A groove 254 in the inner member 250 includes at least one wider segment 256 of larger axial dimension than the remainder of the groove. A groove 258 in the outer race 252 also includes a wider segment 260 of larger axial dimension than the remainder of the groove. These provide relief areas within which the ball bearing is able to freely move about between periods when the ball is channeled in the narrower portions of the bearing grooves. The wider groove areas or segments 256 and 260 permit slack or play in the relative rotation of the two members. This permits a measure of randomization as the outer race slips over the inner member.

Figures 25A, 25B, 25C:
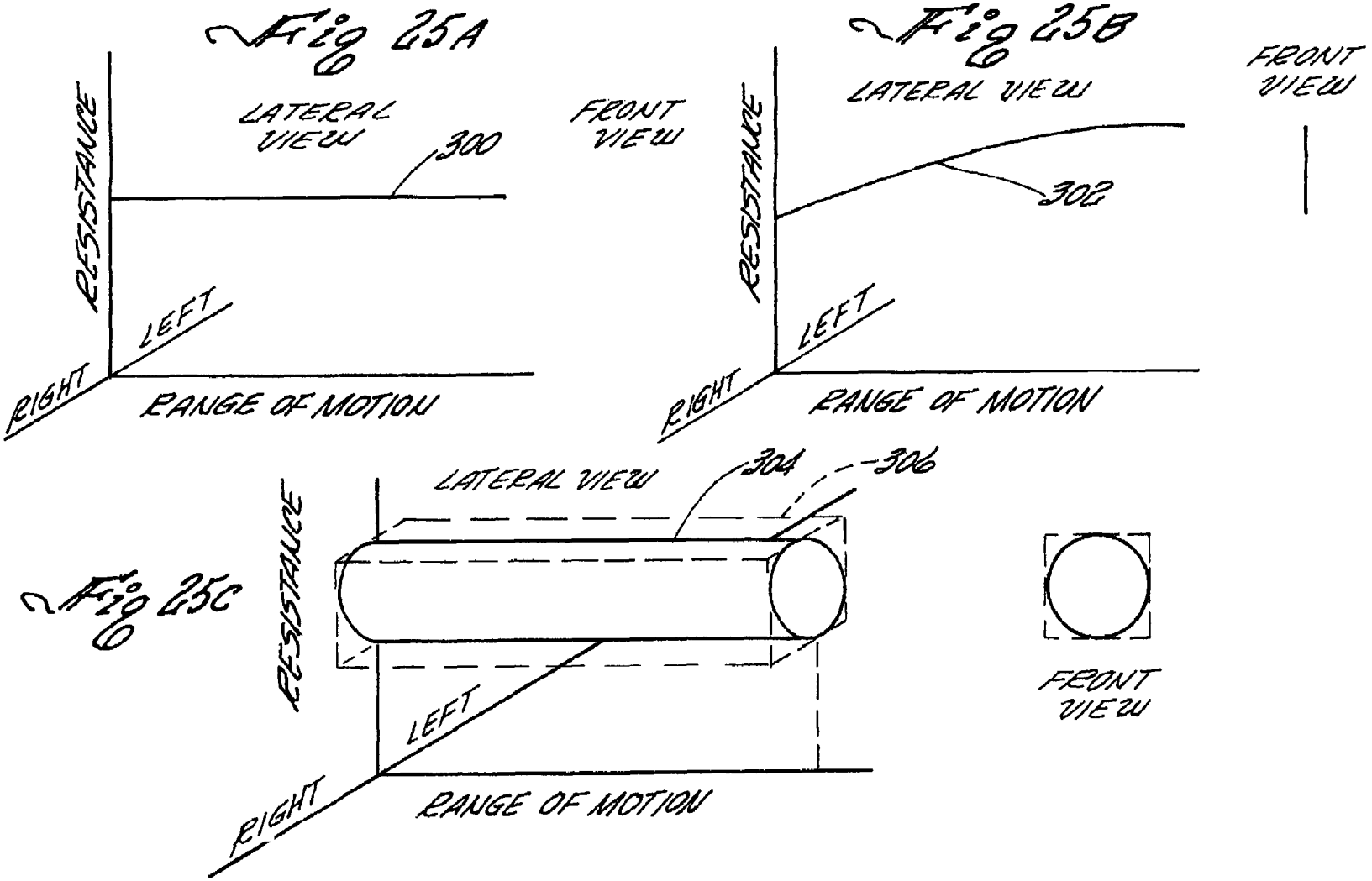
FIG. 25A is a graphical representation of the resistance pattern of an isotonic exercise over a range of motion and numerous repetitions.
FIG. 25B is a graphical representation of the resistance pattern of a "Nautilus-type" exercise device over a range of motion and numerous repetitions.
FIG. 25C is a graphical representation of the resistance pattern of an exercise device of the present invention over a range of motion and numerous repetitions.

FIGS. 25A and 25B are three-dimensional graphical representations of the resistance vector of current/standard pulleys to show their limited ranges of muscle conditioning. The Y-axis represents the resistance magnitude, while the Z-axis represents the right to left movement of the resistance vector. The X-axis is labeled "RANGE OF MOTION" because it shows the change in force magnitude and direction over a multitude of repetitions of a single range of motion superimposed over each other. The resultant graphs for the present invention are typically three dimensional solids because of the left and right motions.

FIG. 25A illustrates the resistance response line 300 of a standard circular pulley system wherein the resistance remains constant over each repetition. The "Front View" to the right of the "Lateral View" shows a point which reflects the constancy of the force magnitude and the lack of left to right motion.

FIG. 25B illustrates the resistance response curve 302 of a prior art "Nautilus" cam system wherein the resistance increases in the same manner over each repetition. The "Front View" to the right of the "Lateral View" shows a vertical line which reflects the slight change in the force magnitude and the lack of left to right motion.

FIG. 25C illustrates the resistance response volume 304 of an exemplary system of the present invention wherein the magnitude and direction of the resistance both vary over each repetition. Note the cylindrical shape in the "Lateral View" and the circle in the "Front View" which reflects the constantly changing force magnitude and the left to right motion. This cylindrical response might result from the use of a trilobal lead pulley in a PD2 device that randomly moves from side-to-side. Other response patterns result from using non-circular pulleys and other variations described herein. In one example both the magnitude and direction of the resistance vary randomly over each successive repetition so that eventually the response will encompass any point within a rectangular parallelepiped shape 306 as shown in phantom.

FIG. 26A is a perspective view of a basic pull-down/push-down machine 310 that incorporates features of the present invention. A user sits on a seat 312 with his or her knees held down by pads 314. The user reaches up and pulls down on a straight bar 316 that is connected to a cable 318 forming a part of a flexible transmission system.

FIG. 26B is a schematic elevational view of a force transmission system for use in the PD2 device of FIG. 26A. The cable 318 traverses over a lead pulley 320 and then connects at a point 322 to an eccentric cam pulley 324 (a so-called "Nautilus-style" pulley). A circular pulley 326 rotates in conjunction with the cam pulley 324 and has a source of resistance 328 attached thereto via a second cable 330. It will be understood that the user pulls down on the cable 318 against the resistance generated by the source of resistance 328, e.g., a stack of weights. Of course, the source of his 328 can also be an elastic member such as a spring, a pneumatic device, a braked wheel, etc. As it rotates, the eccentric cam pulley 324 causes the magnitude of the resistance transmitted to the final cable 318 to vary. In the illustrated embodiment, the resistance is greatest in the position shown, but as the connection point 322 rotates in a clockwise direction as shown the resistance lessens.

The lead pulley 320 is illustrated as a smooth tri-lobal variety. Rotation of the lead pulley 320 as the user pulls the cable 318 down induces perturbations in the "felt" resistance. More particularly, the "felt" resistance varies depending on how far out from the axis of rotation of the pulley 320 is the cable 318 that traverses the pulley. It should also be noted that the pulley 320 could be mounted at a tilt or on a guided bearing so that the direction of the resistance force felt by the user moves from side to side.

FIG. 27A is a perspective view of a seated rowing exercise device 350 incorporating features of the present invention that induce perturbations to the felt resistance. The device 350 includes a bench 352 that receives the user with his or her feet positioned on a pair of fixed foot platforms 354. The user grasps a pair of hand grips 356 that connect via a pair of cable 358 to a force transmission system. Ultimately, a source of resistance such as a stack of weights provides a force that works against movement of the hand grips 356.

FIG. 27B is a schematic perspective view of a pair of lead pulleys 360 around which the cables 358 traverse. The pulleys 360 are shown as bilobal having sudden steps which cause dynamic or ballistic changes in the "felt" resistance transmitted thereby. The reader will note that the angular orientation of the lobes of the two pulleys 360 are offset, resulting in different resistance curves for the two arms of the user. The system can also be characterized as a bilateral force transmission within which each side unilaterally oscillates. Stated another way, the present invention encompasses exercise devices in which there are more than one contact members and associated force transmission systems that function independently from each other.

The method for performing an exercise using the devices described above requires that the muscle(s) being exercised adapt to a fluctuating resistive force a plurality of times during a repetition. The adaptation requirement provides means for strengthening more cooperating muscles during a repetition than is possible when countering a constant resistive force. The method and device of the present invention enables the noncontiguous innervation of muscles during a repetition. It is noted that the muscles involved in a repetition "learn" how to adapt if the cyclic variations in the resistive force occur synchronously during each repetition. It is, therefore, desirable to design the exercise device such that the rotational orientation of the lead pulley at the beginning of each repetition is different than the orientation of the lead pulley at the beginning of the previous repetition.

While particular embodiments of the present invention have been illustrated and described, it would be obvious to those skilled in the art that various other changes and modifications can be made without departing from the spirit and scope of the invention. For example, as mentioned hereinabove, a variety of means such as pneumatic or hydraulic pumps and programmable controllers therefore, as well as specially designed lead pulleys as described hereinabove can be employed to cause the resistive force to oscillate in magnitude and/or direction during a repetition. With the use of programmable computer means, the waveform and/or the frequency of oscillations in the resistive force can also be made to fluctuate either in a predictable pattern or a random fashion during a repetition. Further, although the invention has been presented using a PD2 device as an example of a device embodying the principles of the method, other resistance-type exercise devices employing an oscillating resistive force during a repetition are contemplated. It is therefore intended to cover in the appended claims all such changes and modifications that are within the scope of this invention.

What is claimed is:

1. An exercise machine for exercising one or more muscles of the body of an exerciser, comprising:

a contact member movable in at least one direction through a distance defining a range of motion;

a source of force;

a mechanical connection that transmits a resistive force from the source of force along a resistive force vector in opposition to movement of the contact member through its range of motion; and a support for the mechanical connection that changes the resistive force vector during movement of the contact member through any one range of motion in accordance with at least one of the patterns selected from the group consisting of:

two or more sinusoidal fluctuations, two or more sawtooth fluctuations, two or more pulses, and two or more square wave changes.

2. The exercise machine of claim 1, wherein the support for the mechanical connection randomly selects the resistive force vector in accordance with a different one of the patterns from one range of motion to the next.

3. The exercise machine of claim 1, wherein the support for the mechanical connection changes the resistive force vector within any one range of motion.

4. The exercise machine of claim 1, wherein the support for the mechanical connection changes the resistive force vector during movement of the contact member through any one range of motion in accordance with a superposition of at least two of the patterns selected from the group.

5. The exercise machine of claim 1, wherein the changes to the resistive force vector occur in the direction of the resistive force vector.

6. The exercise machine of claim 1, wherein the changes to the resistive force vector occur in the magnitude of the resistive force vector.

7. The machine of claim 1, wherein the mechanical connection comprises a flexible transmission member, and the support comprises a pulley having a rotational axis and a groove by which the flexible transmission member is guided, wherein rotation of the pulley causes the changes in the resistive force vector.

8. The machine of claim 1, wherein the support for the mechanical connection is controlled by a device selected from the group consisting of:

a hydraulic pump, a pneumatic pump, and a programmable controller.

9. An exercise machine for exercising one or more muscles of the body of an exerciser, comprising:

a contact member movable in at least one direction through a distance defining a range of motion;

a source of force;

a mechanical connection that transmits a resistive force from the source of force along a resistive force vector in opposition to movement of the contact member through its range of motion; and a support for the mechanical connection that changes the resistive force vector in an oscillating manner during movement of the contact member through any one range of motion and randomly modifies the resistive force vector change from one contact member range of motion to the next.

10. The machine of claim 9, wherein the support for the mechanical connection changes the magnitude of the resistive force vector.

11. The machine of claim 10, wherein the mechanical connection comprises a flexible transmission member, and the support comprises a pulley having a rotational axis and a groove by which the flexible transmission member is guided, wherein the pulley groove is non-circular and the pulley rotates on bearings that permit some variance such that the rotational orientation of the pulley is not always the same at the beginning of each range of motion of the contact member.

12. The machine of claim 9, wherein the support for the mechanical connection changes the direction of the resistive force vector randomly.

13. The machine of claim 12, wherein the mechanical connection comprises a flexible transmission member, and the support comprises a pulley having a rotational axis and a groove by which the flexible transmission member is guided, wherein as the pulley rotates a guide portion of the groove oscillates laterally along the pulley axis of rotation.

14. A pulley-based exercise machine for exercising one or more muscles of the body, comprising:

a contact member movable in at least one direction through a distance defining a range of motion;

a source of force;

a mechanical connection that transmits a resistive force from the source of force along a resistive force vector in opposition to movement of the contact member through its range of motion; and a support for the mechanical connection mounted for rotation about a guided bearing that changes the orientation of the support as the support rotates; and wherein rotation of the support changes the direction of the resistive force a plurality of times during movement of the contact member through its range of motion such that the exerciser experiences an oscillating direction of the resistive force.

15. The machine of claim 14, wherein the guided bearing has:

an outer race defined by a ring-shaped body having an outer surface and a throughbore defined by an inner concave surface interrupted by an inwardly facing race groove;

an inner member defined by an outer convex surface and an inner through bore interrupted by an outwardly facing ball groove; and a ball, wherein the inner member is sized to fit within the throughbore of the outer race such that the convex outer surface conforms closely to the concave inner surface, and the race groove and ball groove define a cylindrical cavity that receives the ball.

16. The machine of claim 14, wherein the guided bearing permits some variance such that the rotational orientation of the support is not always the same at any one position of the contact member through its range of motion.

17. The machine of claim 14, wherein the support comprises a rigid arm one end of which pivots about the guided bearing and at the other end of which the contact member is mounted.

18. The machine of claim 14, wherein the support comprises a pulley that rotates on the guided bearing and wherein the contact member is mounted at the end of a flexible transmission member that passes over the pulley.

19. The machine of claim 18, wherein the pulley is non-circular.

20. An exercise machine for exercising one or more muscles of the body of an exerciser, comprising:

a contact member movable in at least one direction through a distance defining a range of motion;

a source of force;

a flexible transmission member that transmits a resistive force from the source of force along a resistive force vector in opposition to movement of the contact member through its range of motion; and a pulley for the flexible transmission member that changes the magnitude of the resistive force vector during movement of the contact member through its range of motion and randomly modifies the resistive force vector change from one contact member range of motion to the next, wherein the pulley has a rotational axis and a groove by which the flexible transmission member is guided, wherein the pulley groove is non-circular and rotates on bearings that permit some variance such that the rotational orientation of the pulley is not always the same at the beginning of each range of motion of the contact member.

21. An exercise machine for exercising one or more muscles of the body of an exerciser, comprising:

a contact member movable in at least one direction through a distance defining a range of motion;

a source of force;

a mechanical connection that transmits a resistive force from the source of force along a resistive force vector in opposition to movement of the contact member through its range of motion; and a support for the mechanical connection that changes the direction of the resistive force vector during movement of the contact member through its range of motion and randomly modifies the resistive force vector change from one contact member range of motion to the next.

22. The machine of claim 21, wherein the mechanical connection comprises a flexible transmission member, and the support comprises a pulley having a rotational axis and a groove by which the flexible transmission member is guided, wherein as the pulley rotates a guide portion of the groove oscillates laterally along the pulley axis of rotation.

* * * * *